US010295937B2

(12) United States Patent
Sawada et al.

(10) Patent No.: US 10,295,937 B2
(45) Date of Patent: May 21, 2019

(54) FIXING DEVICE AND IMAGE FORMING APPARATUS

(71) Applicants: Kazunari Sawada, Shizuoka (JP); Ippei Fujimoto, Kanagawa (JP); Kenji Ishii, Kanagawa (JP); Hiroyuki Shimada, Tokyo (JP); Takashi Seto, Kanagawa (JP); Hiroshi Yoshinaga, Chiba (JP); Takayuki Seki, Kanagawa (JP)

(72) Inventors: Kazunari Sawada, Shizuoka (JP); Ippei Fujimoto, Kanagawa (JP); Kenji Ishii, Kanagawa (JP); Hiroyuki Shimada, Tokyo (JP); Takashi Seto, Kanagawa (JP); Hiroshi Yoshinaga, Chiba (JP); Takayuki Seki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 11 days.

(21) Appl. No.: 15/684,298

(22) Filed: Aug. 23, 2017

(65) Prior Publication Data

US 2018/0059587 A1 Mar. 1, 2018

(30) Foreign Application Priority Data

Sep. 1, 2016 (JP) ..... 2016-171042
Jul. 7, 2017 (JP) ..... 2017-133681

(51) Int. Cl.
*G03G 15/20* (2006.01)

(52) U.S. Cl.
CPC ..... *G03G 15/2007* (2013.01); *G03G 15/2053* (2013.01); *G03G 2215/2035* (2013.01)

(58) Field of Classification Search
CPC ..... G03G 15/2007
See application file for complete search history.

(56) References Cited

U.S. PATENT DOCUMENTS

2011/0058864 A1 3/2011 Fujimoto et al.
2011/0116846 A1 5/2011 Yamaguchi et al.
(Continued)

FOREIGN PATENT DOCUMENTS

JP 2011-059365 3/2011
JP 2011-237831 11/2011
JP 2012-128220 7/2012

*Primary Examiner* — David M. Gray
*Assistant Examiner* — Michael A Harrison
(74) *Attorney, Agent, or Firm* — Oblon, McClelland, Maier & Neustadt, L.L.P.

(57) ABSTRACT

A fixing device includes a heat generator being disposed inside a loop formed by a rotator and including a heat generating portion to radiate radiant heat. A reflector is disposed inside the loop formed by the rotator and includes a reflection face to reflect the radiant heat radiated from the heat generator toward the rotator. A support supports the reflector. A holder holds each lateral end of the support in a longitudinal direction of the support, which is perpendicular to the rotation direction of the rotator. A fastener attaches the reflector to the support at an attachment position disposed at each lateral end of the reflector in a longitudinal direction of the reflector. The attachment position is disposed outboard from a lateral edge of the heat generating portion of the heat generator and disposed inboard from the holder in the longitudinal direction of the reflector.

20 Claims, 17 Drawing Sheets

(56) References Cited

U.S. PATENT DOCUMENTS

| | | | | |
|---|---|---|---|---|
| 2011/0274453 | A1 | 11/2011 | Shimokawa et al. | |
| 2012/0121305 | A1 | 5/2012 | Yoshikawa et al. | |
| 2012/0155935 | A1 | 6/2012 | Yoshikawa et al. | |
| 2012/0155936 | A1 | 6/2012 | Yamaguchi et al. | |
| 2012/0177423 | A1 | 7/2012 | Imada et al. | |
| 2013/0251430 | A1 | 9/2013 | Fujimoto et al. | |
| 2014/0064804 | A1 | 3/2014 | Yamaguchi et al. | |
| 2014/0270872 | A1 | 9/2014 | Tamaki et al. | |
| 2014/0341624 | A1* | 11/2014 | Arai ..... | G03G 15/2053 399/329 |
| 2015/0078768 | A1 | 3/2015 | Yamaguchi et al. | |
| 2015/0125193 | A1 | 5/2015 | Ishii et al. | |
| 2015/0355586 | A1 | 12/2015 | Fujimoto et al. | |
| 2016/0004197 | A1 | 1/2016 | Imada et al. | |
| 2016/0378027 | A1 | 12/2016 | Sawada et al. | |
| 2017/0010570 | A1 | 1/2017 | Fujimoto et al. | |
| 2017/0102652 | A1 | 4/2017 | Imada et al. | |
| 2017/0185009 | A1 | 6/2017 | Yoshinaga et al. | |

* cited by examiner

FIXING DEVICE AND IMAGE FORMING APPARATUS

CROSS-REFERENCE TO RELATED APPLICATIONS

This patent application is based on and claims priority pursuant to 35 U.S.C. § 119 to Japanese Patent Application Nos. 2016-171042, filed on Sep. 1, 2016. and 2017-133681, filed on Jul. 7, 2017, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a rotator, such as a fixing roller, a fixing belt, and a fixing film, heated by a heater and an abutment, such as a pressure roller and a pressure belt, pressed against the rotator to form a fixing nip therebetween through which a recording medium bearing a toner image is conveyed. As the recording medium bearing the toner image is conveyed through the fixing nip, the rotator and the abutment apply heat and pressure to the recording medium, melting and fixing the toner image on the recording medium.

SUMMARY

This specification describes below an improved fixing device. In one embodiment, the fixing device includes a rotator being formed into a loop and rotatable in a rotation direction. An abutment presses against an outer circumferential surface of the rotator. A heat generator is disposed inside the loop formed by the rotator. The heat generator includes a heat generating portion to radiate radiant heat. A reflector is disposed inside the loop formed by the rotator. The reflector includes a reflection face to reflect the radiant heat radiated from the heat generator toward the rotator. A support supports the reflector. A holder holds each lateral end of the support in a longitudinal direction of the support, which is perpendicular to the rotation direction of the rotator. A fastener attaches the reflector to the support at an attachment position disposed at each lateral end of the reflector in a longitudinal direction of the reflector. The attachment position is disposed outboard from a lateral edge of the heat generating portion of the heat generator and disposed inboard from the holder in the longitudinal direction of the reflector.

This specification further describes an improved fixing device. In one embodiment, the fixing device includes a rotator being formed into a loop and rotatable in a rotation direction. An abutment presses against an outer circumferential surface of the rotator in a pressurization direction. A heat generator, which is disposed inside the loop formed by the rotator, radiates radiant heat. A reflector is disposed inside the loop formed by the rotator. A support supports the reflector. A fastener fastens the reflector to the support at an attachment position disposed at each lateral end of the reflector in a longitudinal direction of the reflector. The reflector includes a reflection face to reflect the radiant heat radiated from the heat generator toward the rotator. The reflection face includes an angled portion angled relative to the pressurization direction and disposed on at least a part of the reflection face. The reflector further includes an attachment portion that contacts the fastener to prevent the reflector from being deformed in accordance with deformation of the support by pressure exerted by the abutment and being pivoted about the fastener in a surface direction parallel to the reflection face of the reflector.

This specification further describes an improved image forming apparatus. In one embodiment, the image forming apparatus includes an image forming device to form a toner image on a recording medium and a fixing device to fix the toner image on the recording medium. The fixing device includes a rotator being formed into a loop and rotatable in a rotation direction. An abutment presses against an outer circumferential surface of the rotator. A heat generator is disposed inside the loop formed by the rotator. The heat generator includes a heat generating portion to radiate radiant heat. A reflector is disposed inside the loop formed by the rotator. The reflector includes a reflection face to reflect the radiant heat radiated from the heat generator toward the rotator. A support supports the reflector. A holder holds each lateral end of the support in a longitudinal direction of the support, which is perpendicular to the rotation direction of the rotator. A fastener attaches the reflector to the support at an attachment position disposed at each lateral end of the reflector in a longitudinal direction of the reflector. The attachment position is disposed outboard from a lateral edge of the heat generating portion of the heat generator and disposed inboard from the holder in the longitudinal direction of the reflector.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
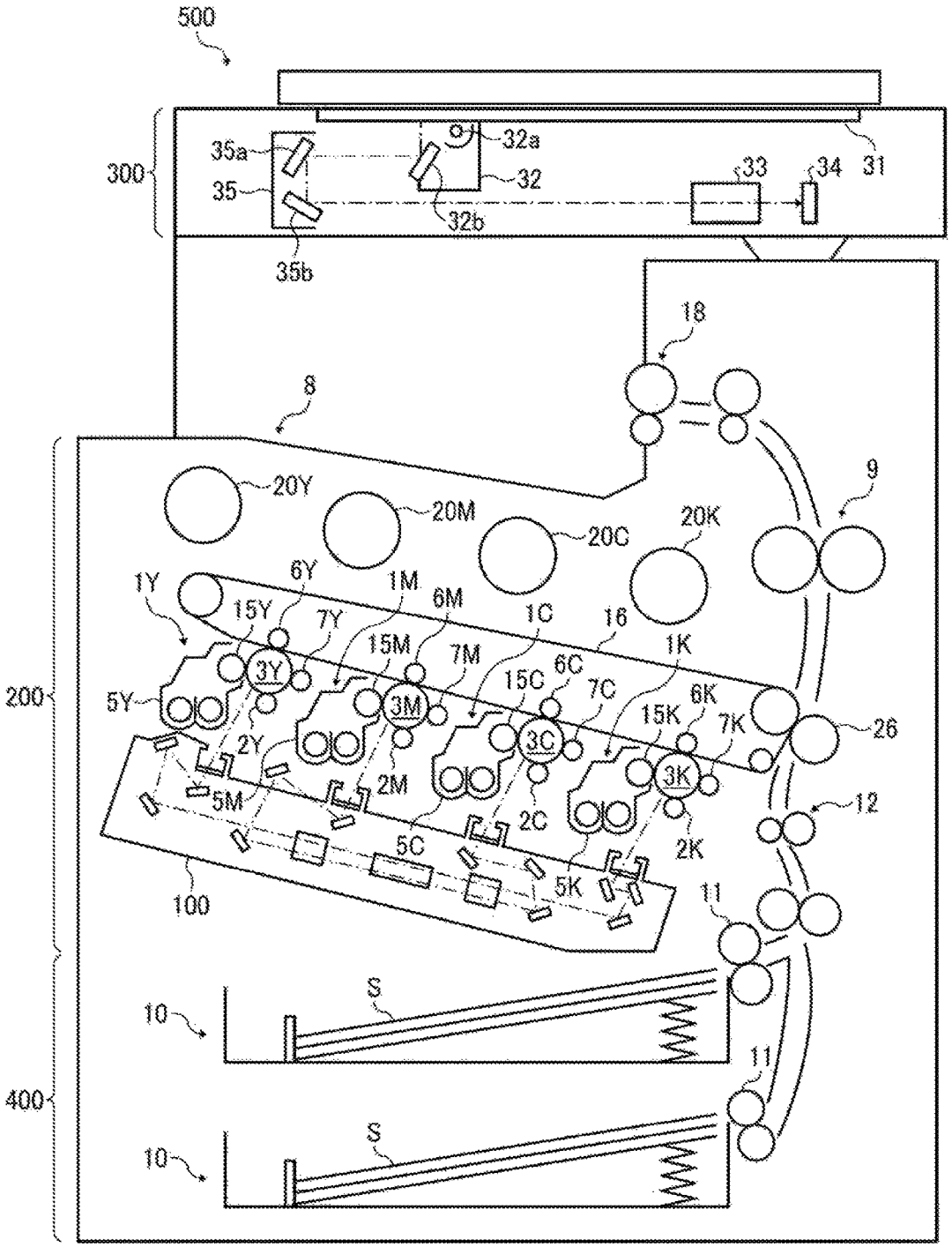
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 500 according to an embodiment is explained.

FIG. 1 is a schematic vertical cross-sectional view of the image forming apparatus 500. The image forming apparatus 500 may be a copier, a facsimile machine, a printer, a multifunction peripheral or a multifunction printer (MFP) having at least one of copying, printing, scanning, facsimile, and plotter functions, or the like. According to this embodiment, the image forming apparatus 500 is a color copier that forms a color toner image on a recording medium by electrophotography. Alternatively, the image forming apparatus 500 may be a monochrome copier that forms a monochrome toner image on a recording medium.

Referring to FIG. 1, a description is provided of a construction of the image forming apparatus 500.

As illustrated in FIG. 1, the image forming apparatus 500 includes an image forming section 200, a sheet feeder 400 disposed below the image forming section 200, and a scanner 300 disposed above the image forming section 200.

A detailed description is now given of a construction of the image forming section 200.

The image forming section 200 includes four image forming devices 1Y, 1M, 1C, and 1K that form yellow, magenta, cyan, and black toner images, respectively. Suffixes Y M, C, and K are assigned to reference numerals of components that are used to form the yellow, magenta, cyan, and black toner images, respectively. Since the four image forming devices 1Y, 1M, 1C, and 1K have a substantially identical construction except for the color of toner, the suffixes Y, M, C, and K indicating the color of toner are omitted as needed.

Each of the image forming devices 1Y, 1M, 1C, and 1K includes a photoconductor 3 (e.g., photoconductors 3Y, 3M, 3C, and 3K) serving as an image bearer or a latent image bearer that bears an electrostatic latent image and a resultant toner image: a charger 2 (e.g., chargers 2Y, 2M, 2C and 2K) that charges an outer circumferential surface of the photoconductor 3; a developing device 5 (e.g., developing devices 5Y, 5M, 5C, and 5K) that supplies toner to the electrostatic latent image formed on the outer circumferential surface of the photoconductor 3; thus visualizing the electrostatic latent image as a toner image; and a cleaner 7 (e.g., cleaners 7Y, 7M, 7C, and 7K) that cleans the outer circumferential surface of the photoconductor 3.

The image forming section 200 further includes a writing unit 100, an intermediate transfer belt 16, four primary transfer rollers 6Y, 6M, 6C, and 6K, a secondary transfer roller 26, and a registration roller pair 12. The writing unit 100 writes an electrostatic latent image on the respective photoconductors 3Y, 3M, 3C, and 3K. The intermediate transfer belt 16 bears yellow, magenta, cyan, and black toner images primarily transferred from the photoconductors 3Y, 3M, 3C, and 3K, respectively. The four primary transfer rollers 6Y, 6M, 6C, and 6K primarily transfer the yellow, magenta, cyan, and black toner images formed on the four photoconductors 3Y, 3M, 3C, and 3K onto the intermediate transfer belt 16, respectively, thus forming a color toner image on the intermediate transfer belt 16. The secondary transfer roller 26 is disposed opposite the intermediate transfer belt 16 to form a secondary transfer nip therebetween where the secondary transfer roller 26 secondarily transfers the color toner image formed on the intermediate transfer belt 16 onto a transfer sheet S serving as a recording medium. Upstream from the secondary transfer nip in a sheet conveyance direction is the registration roller pair 12 that halts the transfer sheet S temporarily.

The image forming section 200 further includes four toner bottles 20Y, 20M, 20C, and 20K, a fixing device 9, and an output roller pair 18. The toner bottles 20Y, 20M, 20C, and 20K contain fresh yellow, magenta, cyan, and black toners to be supplied to the developing devices 5Y, 5M, 5C and 5K that consume the yellow, magenta, cyan, and black toners, respectively. Downstream from the secondary transfer roller 26 in the sheet conveyance direction, that is, above the secondary transfer roller 26 in FIG. 1, is the fixing device 9. Downstream from the fixing device 9 in the sheet conveyance direction is the output roller pair 18.

A detailed description is now given of a construction of the sheet feeder 400.

The sheet feeder 400 includes a plurality of paper trays 10 that contains a plurality of transfer sheets S and a plurality of feed rollers 11. Each of the paper trays 10 includes a load plate that loads the plurality of transfer sheets S. Each of the feed rollers 11 separates an uppermost transfer sheet S from other transfer sheets S placed on each of the paper trays 10 and feeds the uppermost transfer sheet S to the registration roller pair 12.

A detailed description is now given of a construction of the scanner 300.

The scanner 300 includes an exposure glass 31 on which an original is placed. The scanner 300 further includes components that scan the original placed on the exposure glass 31. For example, the scanner 300 includes a first carriage 32 and a second carriage 35. The first carriage 32 mounts a light source 32*a* that emits light to irradiate the original and a first mirror 32*b*. The second carriage 35 mounts a second mirror 35*a* and a third mirror 35*b*. The scanner 300 further includes a lens 33 and a charge-coupled device (CCD) 34, that is, a CCD image sensor, disposed behind the lens 33.

A description is provided of an image forming operation performed by the image forming apparatus 500.

As a user places an original on the exposure glass 31 and starts an image forming operation, the light source 32*a* irradiates the original through the exposure glass 31 with light. Reflection light reflected by the original is reflected by the first mirror 32*b*, the second mirror 35*a*, and the third mirror 35*b*. The lens 33 forms the light into an image that enters the CCD 34. The scanner 300 creates image data based on the light entered into the CCD 34 so that the image forming section 200 forms a toner image on a transfer sheet S according to the image data.

In the image forming section 200, the charger 2 uniformly charges the outer circumferential surface of the photoconductor 3 while the photoconductor 3 rotates. The writing unit 100 is driven according to the image data. A light source of the writing unit 100 emits light according to the image data. The light irradiates and scans the uniformly charged outer circumferential surface of the photoconductor 3, forming an electrostatic latent image on the photoconductor 3. A developing roller 15 (e.g., developing rollers 15Y, 15M, 15C, and 15K) of the developing device 5 supplies developer (e.g., toner) to the electrostatic latent image formed on the photoconductor 3 to develop the electrostatic latent image into a toner image as a visible image.

While the toner image is formed on the photoconductor 3, the feed roller 11 picks up a transfer sheet S from one of the plurality of paper trays 10 that is selected and feeds the transfer sheet S to the registration roller pair 12. As a leading edge of the transfer sheet S comes into contact with a nip formed by the registration roller pair 12, the registration roller pair 12 halts the transfer sheet S. The four primary transfer rollers 6Y, 6M, 6C, and 6K primarily transfer yellow, magenta, cyan, and black toner images formed on the photoconductors 3Y, 3M, 3C, and 3K onto the intermediate transfer belt 16 at four primary transfer nips formed between the photoconductors 3Y, 3M, 3C, and 3K and the intermediate transfer belt 16, respectively, such that the yellow, magenta, cyan, and black toner images are superimposed on a same position on the intermediate transfer belt 16 to form a color toner image thereon. The registration roller pair 12 resumes rotation to convey the transfer sheet S to the secondary transfer nip at a time when the color toner image formed on the intermediate transfer belt 16 reaches the secondary transfer nip. As the transfer sheet S transferred with the color toner image at the secondary transfer nip comes into contact with a discharging brush, the transfer sheet S is discharged by the discharging brush. After the transfer sheet S is mechanically separated from the intermediate transfer belt 16, the transfer sheet S is conveyed to the fixing device 9.

The fixing device 9 fixes the color toner image on the transfer sheet S under heat and pressure. The transfer sheet S bearing the fixed color toner image after passing through the fixing device 9 is ejected by the output roller pair 18 onto an output tray 8. After the primary transfer of the yellow, magenta, cyan, and black toner images from the photoconductors 3Y, 3M, 3C, and 3K onto the intermediate transfer belt 16, the cleaners 7Y, 7M, 7C, and 7K remove residual toner failed to be transferred onto the intermediate transfer belt 16 and therefore remaining on the outer circumferential surface of the respective photoconductors 3Y, 3M, 3C, and 3K therefrom. The removed toner is collected into a waste toner container. A discharger discharges the outer circumferential surface of the respective photoconductors 3Y, 3M, 3C, and 3K, rendering the photoconductors 3Y, 3M, 3C, and 3K to be ready for a next image forming operation.

The above describes an image forming operation in which the scanner 300 reads an image on an original into image data and the image forming section 200 forms a color toner image according to the image data. Alternatively, the image forming apparatus 500 may form a toner image according to image data sent from an external electronic device such as a client computer.

The image forming apparatus 500 employs an intermediate transfer method for transferring a toner image formed on the photoconductor 3 onto a transfer sheet S via the intermediate transfer belt 16 serving as an intermediate transferor. Alternatively, the image forming apparatus 500 may employ a direct transfer method for transferring a toner image formed on the photoconductor 3 onto a transfer sheet S directly.

Figure 2:
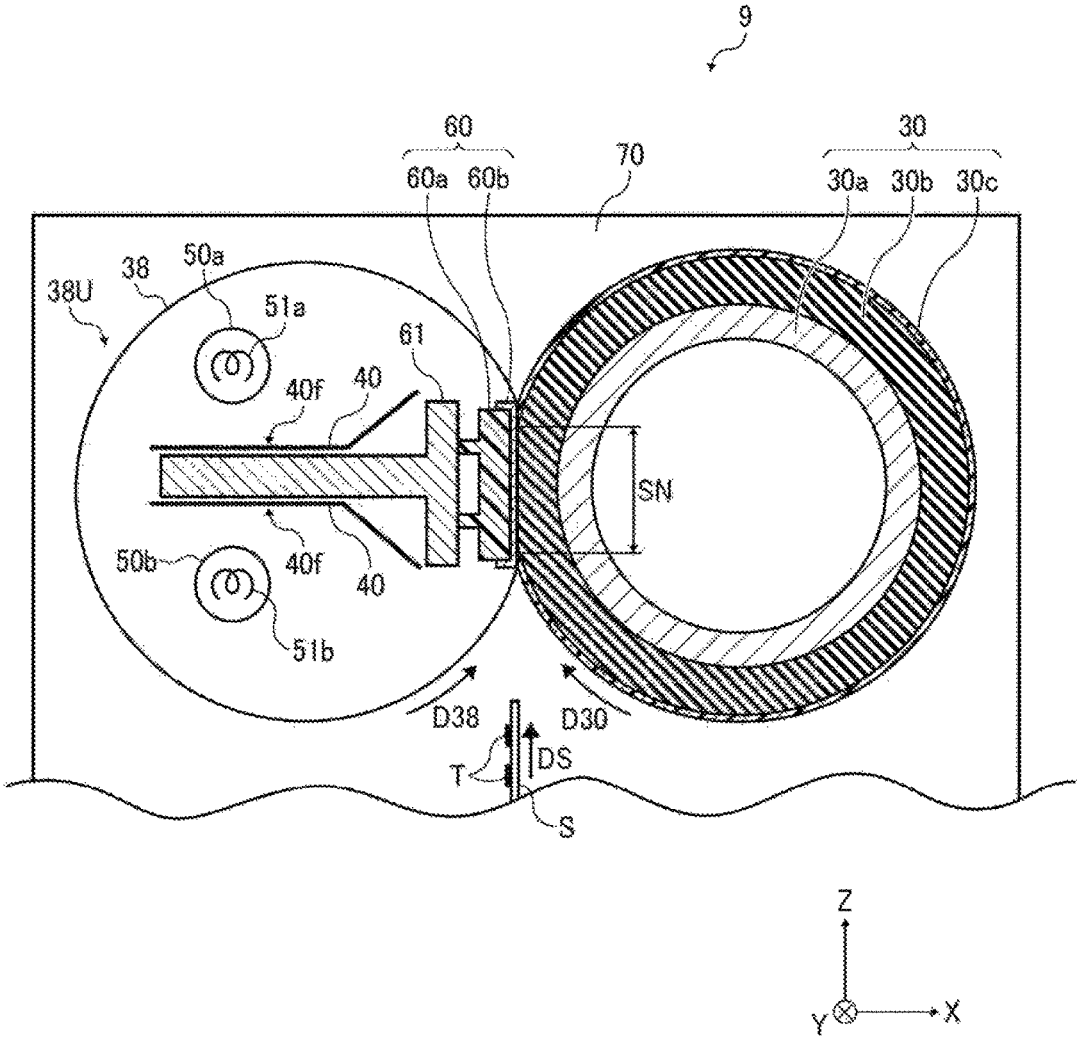
FIG. 2 is a schematic vertical cross-sectional view of a fixing device incorporated in the image forming apparatus depicted in FIG. 1, illustrating a reflector.

Referring to FIG. 2, a description is provided of a construction of the fixing device 9 incorporated in the image forming apparatus 500 having the construction described above.

FIG. 2 is a schematic vertical cross-sectional view of the fixing device 9. As illustrated in FIG. 2, the fixing device 9 (e.g., a fuser or a fusing unit) includes a substantially tubular fixing belt 38 serving as a rotator or a fixing rotator rotatable in a rotation direction D38 and a pressure roller 30, serving as an abutment or a pressure rotator rotatable in a rotation direction D30, to come into contact with the fixing belt 38 to drive the fixing belt 38. Alternatively, the fixing belt 38 may be driven and rotated by a driver coupled with the fixing belt 38. Inside a loop formed by the fixing belt 38 are a pressure pad 60 serving as a nip formation pad, a stay 61 serving as a support, and a first halogen heater 50*a* and a second halogen heater 50*b* serving as a plurality of heat generators.

As illustrated in FIG. 2, the first halogen heater 50*a* is disposed opposite the second halogen heater 50*b* vertically via the stay 61. A reflector 40 is interposed between the stay 61 and each of the first halogen heater 50*a* and the second halogen heater 50*b* to reflect radiant heat or light radiated from the first halogen heater 50*a* and the second halogen heater 50*b* toward an inner circumferential surface of the fixing belt 38.

A supporting side plate 70 is disposed at each lateral end of the fixing device 9 in a longitudinal direction thereof parallel to an axial direction of the fixing belt 38. The supporting side plate 70 is a part of a frame of the image forming apparatus 500 that supports the components of the fixing device 9 described above. The fixing belt 38 and the components situated inside the loop formed by the fixing belt 38, that is, the reflector 40, the first halogen heater 50*a*, the second halogen heater 50*b*, the pressure pad 60, and the stay 61, may construct a belt unit 38U separably coupled with the pressure roller 30.

A detailed description is now given of a construction of the fixing belt 38.

The fixing belt 38 is a tubular heating rotator that is flexibly deformable and rotatable in the rotation direction D38. The fixing belt 38 is constructed of a base layer, an elastic layer coating the base layer, and a release layer coating the elastic layer. The tubular fixing belt 38 has an outer diameter of 30 mm. The base layer made of nickel (Ni) has a thickness in a range of from 10 micrometers to 70 micrometers. The elastic layer made of silicone rubber has a thickness in a range of from 50 micrometers to 150 micrometers. The release layer serving as an outermost layer of the fixing belt 38 has a thickness in a range of from 5 micrometers to 50 micrometers and is made of fluoroplastic to enhance durability of the fixing belt 38 and facilitate separation of toner of a toner image T on a transfer sheet S from the fixing belt 38. The fluoroplastic of the release layer is tetrafluoroethylene-perfluoroalkylvinylether copolymer (PFA), polytetrafluoroethylene (PTFE), or the like. Alternatively, the release layer may be made of other fluoroplastic. Further, the base layer of the fixing belt 38 may be made of a material other than nickel, for example, metal such as SUS stainless steel or heat resistant resin such as polyimide (PI).

A detailed description is now given of a construction of the pressure roller 30.

The pressure roller 30, having an outer diameter of 30 mm, is constructed of a hollow core bar 30*a* made of iron, an elastic layer 30*b* coating the core bar 30*a*, and a release layer 30*c* coating the elastic layer 30*b*. The elastic layer 30*b*, made of silicone rubber, has a thickness of 5 mm. The fluoroplastic release layer 30*c* having a thickness of about 40 micrometers may coat the elastic layer 30*b* to facilitate separation of a foreign substance (e.g., paper dust and toner) from the pressure roller 30. A pressurization assembly biases and presses the pressure roller 30 against the fixing belt 38 to form a fixing nip SN between the pressure roller 30 and the fixing belt 38.

A detailed description is now given of a construction of the pressure pad 60.

The pressure pad 60 is constructed of a resin portion 60*a* and a thermal equalizer 60*b*. The resin portion 60*a* is made of heat resistant resin such as liquid crystal polymer (LCP). The thermal equalizer 60*b*, made of copper, coats the resin portion 60*a*. As the inner circumferential surface of the fixing belt 38 slides over the thermal equalizer 60*b*, the thermal equalizer 60*b* equalizes temperature distribution of the fixing belt 38 in the axial direction thereof. The pressure pad 60 presses against the pressure roller 30 via the fixing belt 38 to form the fixing nip SN between the fixing belt 38 and the pressure roller 30.

A detailed description is now given of a configuration of the stay 61.

The pressure pad 60 is mounted on and supported by the stay 61. The stay 61 serves as a reinforcement that contacts an inner face of the pressure pad 60 and reinforces the pressure pad 60 against pressure from the pressure roller 30. Each lateral end of the stay 61 in a longitudinal direction thereof parallel to the axial direction of the fixing belt 38 is supported by the supporting side plate 70. The stay 61 receives pressure exerted from the pressure roller 30 to the pressure pad 60, allowing the pressure pad 60 to form the fixing nip SN between the fixing belt 38 and the pressure roller 30.

A detailed description is now given of a construction of the first halogen heater 50*a* and the second halogen heater 50*b*.

The first halogen heater 50*a* is disposed opposite the second halogen heater 50*b* vertically in FIG. 2 via the stay 61. A heater holder disposed outboard from the supporting side plate 70 in the longitudinal direction of the fixing device 9 supports each lateral end of each of the first halogen heater 50*a* and the second halogen heater 50*b* in a longitudinal direction thereof parallel to the axial direction of the fixing bell 38.

The first halogen heater 50*a* includes a first light emitting filament 51*a* spanning a decreased span in the longitudinal direction of the first halogen heater 50*a*. The decreased span corresponds to a width of a small transfer sheet S in a width direction thereof parallel to the longitudinal direction of the first halogen heater 50*a*. The second halogen heater 50*b* includes a second light emitting filament 51*b* disposed outboard from the decreased span of the first light emitting filament 51*a* in the longitudinal direction of the second halogen heater 50*b*. The first light emitting filament 51*a* and the second light emitting filament 51*b* span an increased span in the longitudinal direction of the second halogen heater 50*b*. The increased span corresponds to a width of a large transfer sheet S in a width direction thereof parallel to the longitudinal direction of the second halogen heater 50*b*.

A detailed description is now given of a construction of the reflector 40.

The reflector 40 is interposed between the stay 61 and each of the first halogen heater 50*a* and the second halogen heater 50*b*. Thus, the stay 61 is disposed opposite each of the first halogen heater 50*a* and the second halogen heater 50*b* via the reflector 40. Each lateral end of the reflector 40 in a longitudinal direction thereof parallel to the axial direction of the fixing bell 38 is supported by the stay 61 through a shoulder screw 43 described below. The reflector 40 is constructed of an aluminum base and a silver paste layer coating the base. The reflector 40 includes a reflection face 40*f* that reflects radiant heat or light radiated from the first halogen heater 50*a* and the second halogen heater 50*b* toward the fixing belt 38. The reflector 40 is a plate bent at a plurality of spots to shield the stay 61 and the pressure pad 60 from the first halogen heater 50*a* and the second halogen heater 50*b*.

Figure 3:
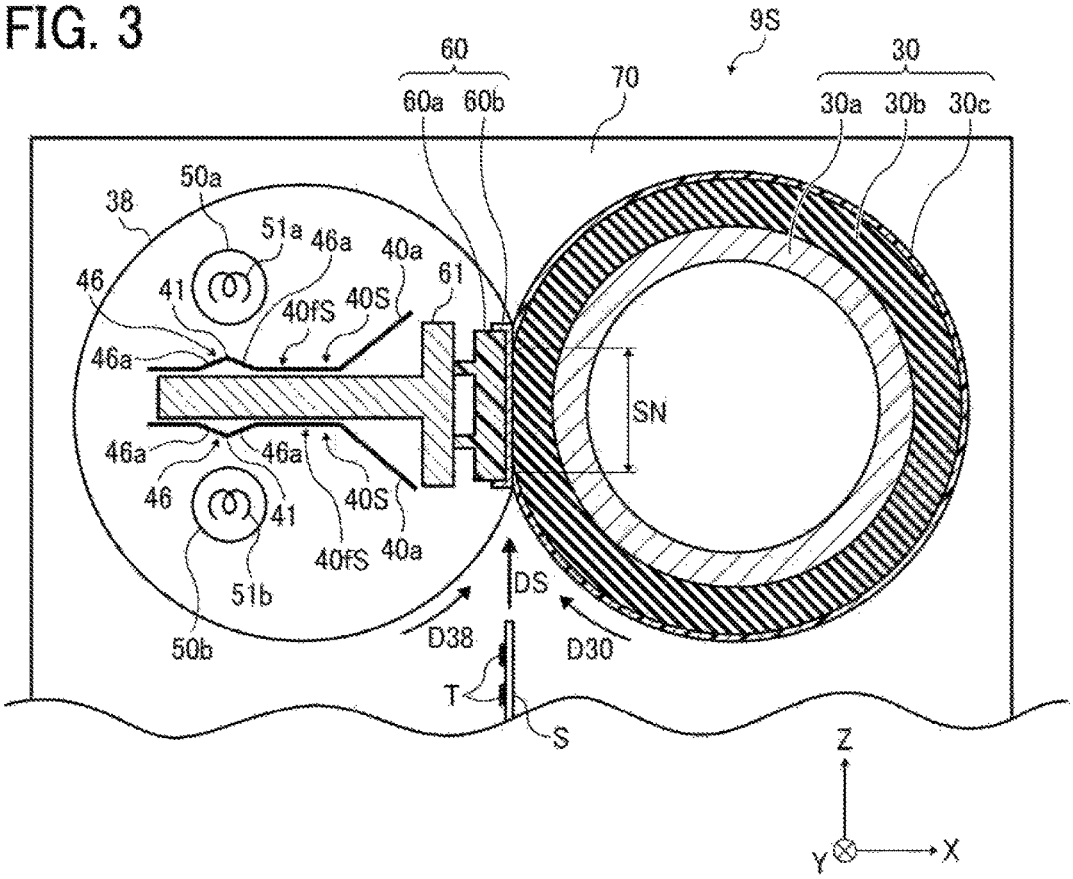
FIG. 3 is a schematic vertical cross-sectional view of a fixing device incorporating a reflector as a variation of the reflector depicted in FIG. 2.

FIG. 3 is a schematic vertical cross-sectional view of a fixing device 9S incorporating a reflector 40S as a variation of the reflector 40 depicted in FIG. 2. As illustrated in FIG. 3, the reflector 40S includes a reflection face 40*f*S including a gable 46 (e.g., a projection) that reflects radiant heat or light radiated from the first halogen heater 50*a* and the second halogen heater 50*b* in a reflection direction different from an incident direction of the radiant heat or light.

Since the reflector 40S shares a common configuration with the reflector 40 except for the shape of an opposed portion of the reflector 40S that is disposed opposite each of the first halogen heater 50*a* and the second halogen heater 50*b*, the following describes a configuration of the opposed portion of the reflectors 40S.

The gable 46 has a summit 41 situated at an intersection where the reflection face 40*f*S intersects a perpendicular defined by a center (e.g., an axis) in a direction perpendicular to the axial direction of the fixing belt 38 of each of the lust halogen heater 50*a* and the second halogen heater 50*b* and the reflection face 40*f*S. Radiant heat or light emitted from each of the first halogen heater 50*a* and the second halogen heater 50*b* and directed to the reflection face 40*f*S in the incident direction along the perpendicular irradiates slopes 46*a* of the gable 46. Since the incident direction of the radiant heat or light is not perpendicular to the slopes 46*a* of the gable 46, the radiant heat or light is reflected by the gable 46 in the reflection direction different from the incident direction. Accordingly, the reflection face 40*f*S reflects the radiant heat or light irradiating the reflection face 40*f*S toward the fixing belt 38, not toward the first halogen heater 50*a* and the second halogen heater 50*b*, preventing the reflected heat or light from penetrating through and heating the first halogen heater 50*a* and the second halogen heater 50*b*.

A detailed description is now given of a construction of the supporting side plate 70.

Figure 4:
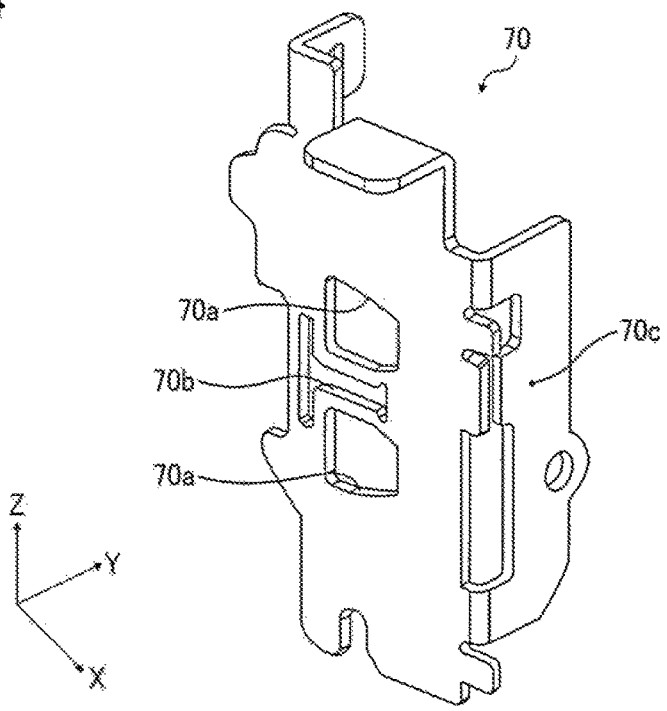
FIG. 4 is a perspective view of a supporting side plate incorporated in the fixing devices depicted in FIGS. 2 and 3.

FIG. 4 is a perspective view of the supporting side plate 70. The supporting side plate 70 serving as a holder includes an engaging hole 70*b* that engages the stay 61 depicted in FIGS. 2 and 3 and a plurality of through holes 70*a* through which the first halogen heater 50*a* and the second halogen heater 50*b* penetrate, respectively. The supporting side plate 70 further includes a bridge mount 70*c* that mounts a bridge 72 (e.g., a coupling plate) described below that bridges the supporting side plate 70 disposed at one lateral end of the fixing device 9 and the supporting side plate 70 disposed at another lateral end of the fixing device 9 in the longitudinal direction thereof.

Figure 5:
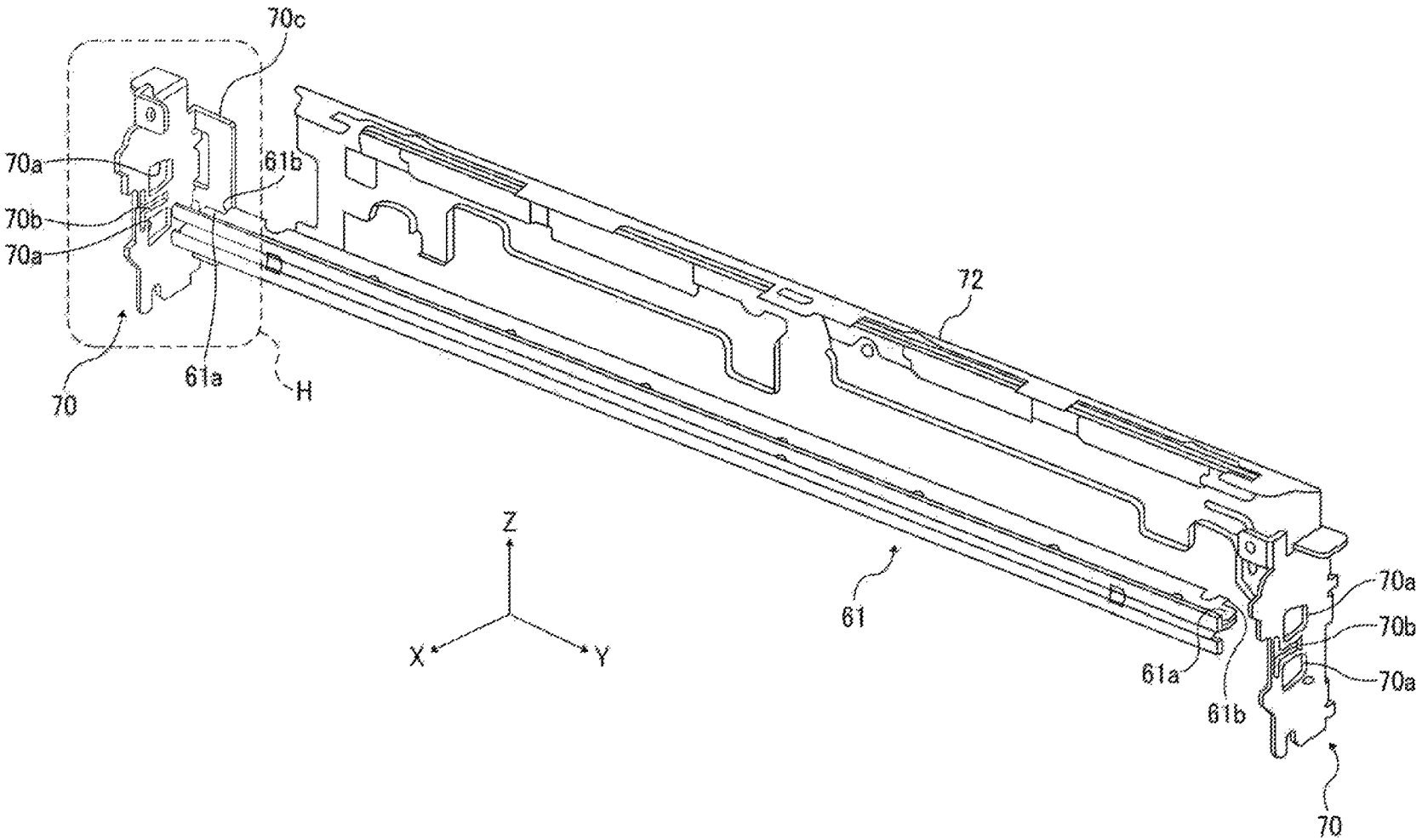
FIG. 5 is an exploded perspective view of a stay, the supporting side plates, and a bridge incorporated in the fixing devices depicted in FIGS. 2 and 3.
Figure 6:
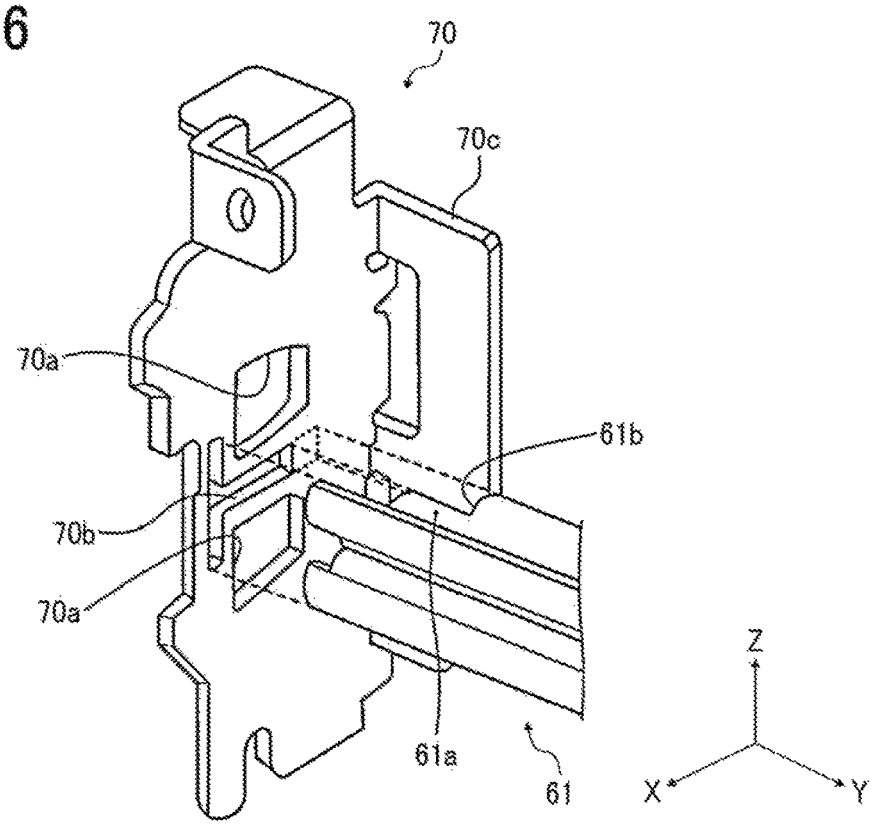
FIG. 6 is an enlarged perspective view of the supporting side plate and the stay that are enclosed by a dotted line in FIG. 5.
Figure 7:
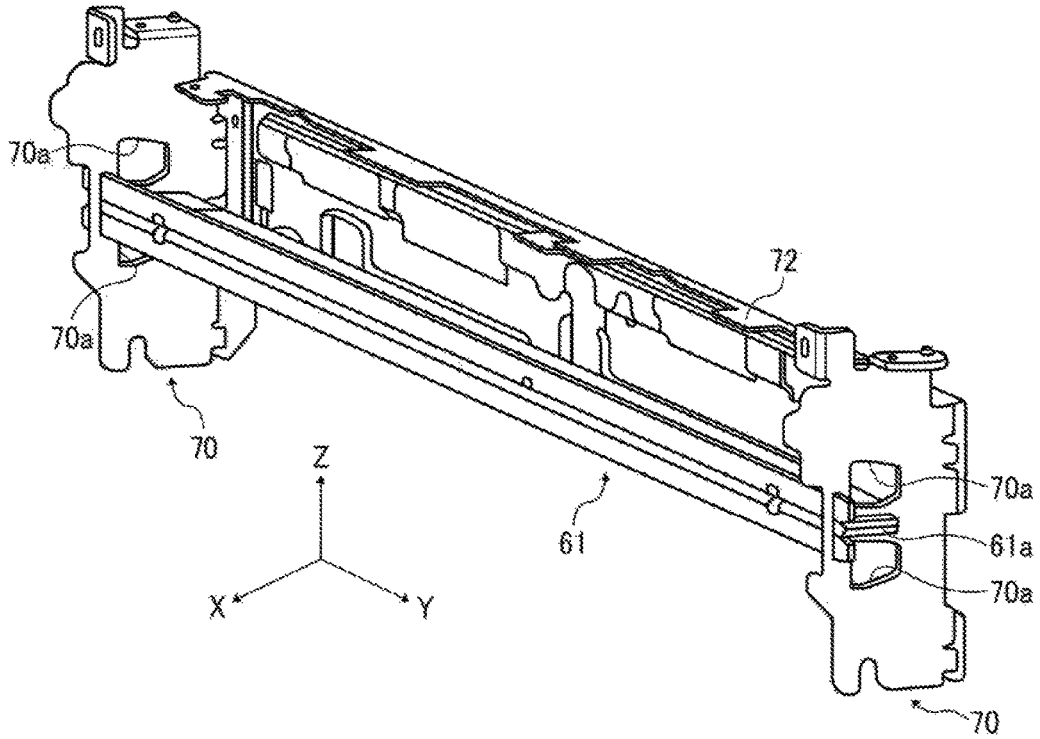
FIG. 7 is a perspective view of the stay, the supporting side plates, and the bridge depicted in FIG. 5.
Figure 8:
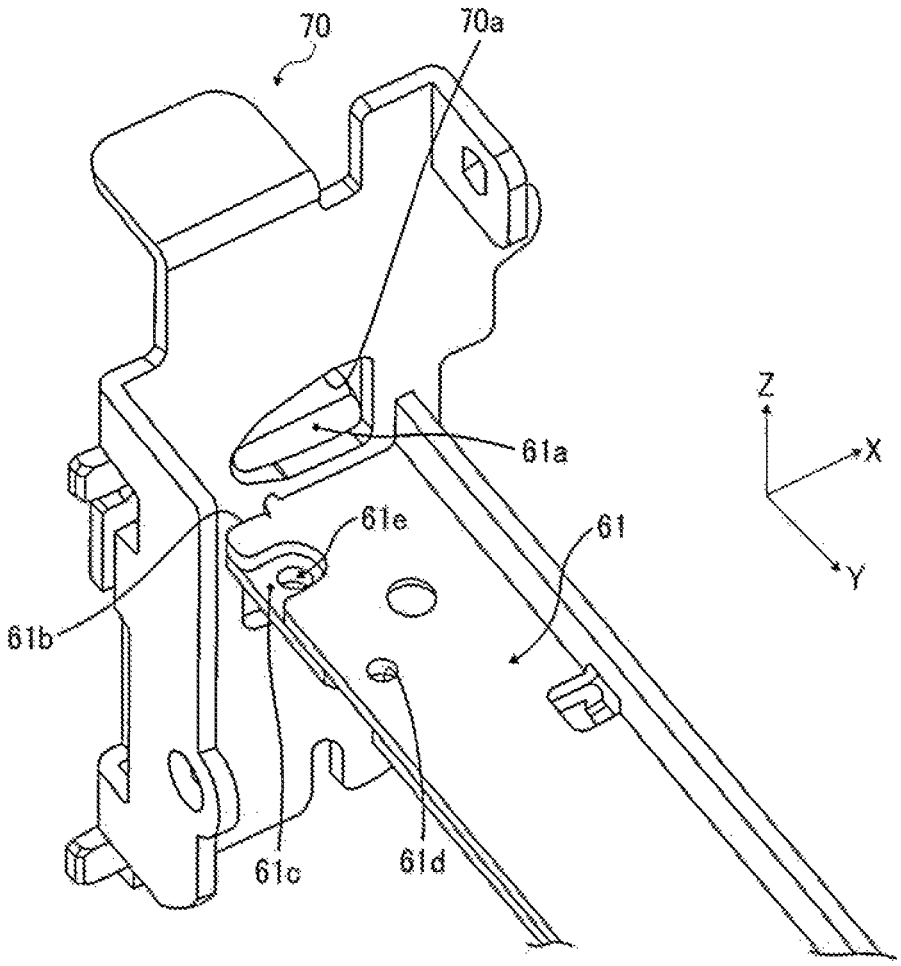
FIG. 8 is an enlarged perspective view of the stay attached to the supporting side plate depicted in FIG. 6.

FIG. 5 is an exploded perspective view of the stay 61, the supporting side plates 70, and the bridge 72. FIG. 6 is an enlarged perspective view of the supporting side plate 70 and the stay 61 that are enclosed by a dotted line H in FIG. 5. FIG. 7 is a perspective view of the stay 61, the supporting side plates 70, and the bridge 72. FIG. 8 is an enlarged perspective view of the stay 61 attached to the supporting side plate 70.

As illustrated in FIG. 6, each lateral end of the stay 61 in the longitudinal direction thereof (e.g., a direction Y) has a step that defines an engaging portion 61*a* and an abutment 61*b*. The engaging portion 61*a* engages the engaging hole 70*b* of the supporting side plate 70. The abutment 61*b* abuts on the supporting side plate 70.

As illustrated in FIG. 8, the stay 61 further includes screw holes 61*d* and 61*e* used to fasten the reflector 40 to the stay 61. The screw hole 61*e* is used to fasten the reflector 40 to a second face, that is, a lower face or an upstream face of the stay 61 in a sheet conveyance direction DS depicted in FIGS. 2 and 3. The screw hole 61*d* is used to fasten the reflector 40 to a first face, that is, an upper face or a downstream face of the stay 61 in the sheet conveyance direction DS depicted in FIGS. 2 and 3. A detailed description of attachment of the reflector 40 to the stay 61 is deferred.

A description is provided of attachment of the stay 61 to the supporting side plates 70.

As illustrated in FIG. 6, the engaging portion 61*a* disposed at one lateral end of the stay 61 in the longitudinal direction thereof is inserted into the engaging hole 70*b* until the abutment 61*b* disposed at one lateral end of the stay 61 in the longitudinal direction thereof comes into contact with the supporting side plate 70 disposed opposite one lateral end of the stay 61 in the longitudinal direction thereof. Subsequently, the engaging hole 70*b* of the supporting side plate 70 disposed opposite another lateral end of the stay 61 in the longitudinal direction thereof is fitted onto the engaging portion 61*a* until the abutment 61*b* disposed at another lateral end of the stay 61 in the longitudinal direction thereof comes into contact with the supporting side plate 70 disposed opposite another lateral end of the stay 61 in the longitudinal direction thereof. As illustrated in FIG. 7, one lateral end of the bridge 72 in a longitudinal direction thereof is fastened to the supporting side plate 70 disposed opposite the one lateral end of the bridge 72 with a screw. Another lateral end of the bridge 72 in the longitudinal direction thereof is fastened to the supporting side plate 70 disposed opposite the another lateral end of the bridge 72 with a screw. Thus, as illustrated in FIG. 7, the stay 61 is secured to and positioned relative to the two supporting side plates 70.

Figure 9:
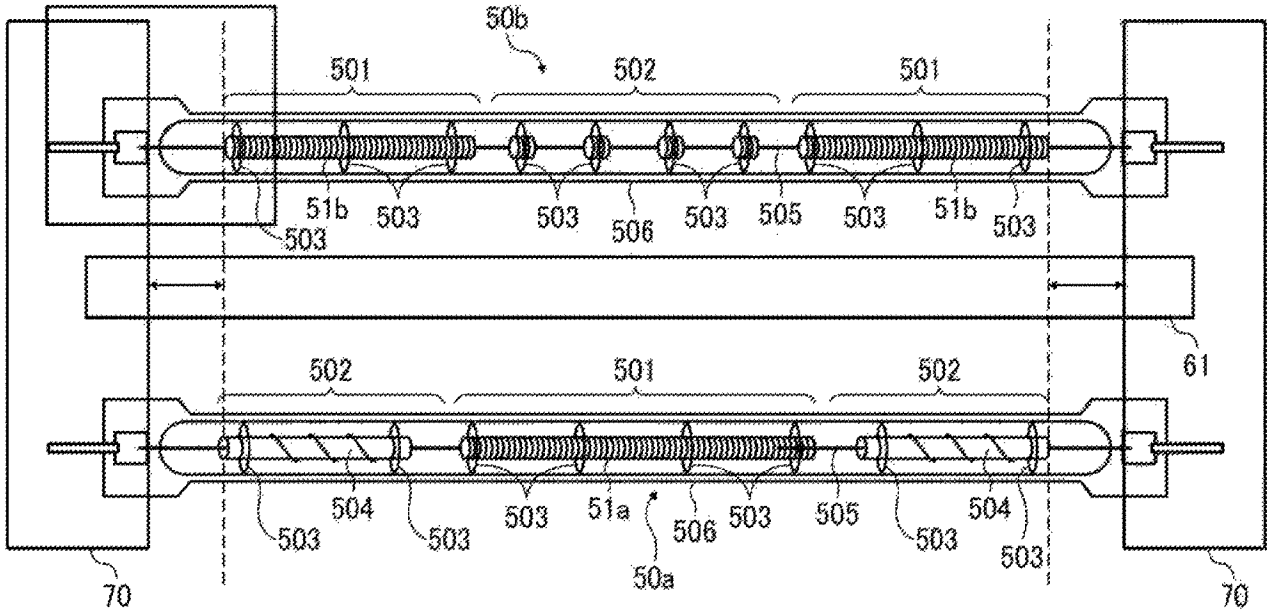
FIG. 9 is a perspective view of a first halogen heater and a second halogen heater incorporated in the fixing devices depicted in FIGS. 2 and 3.

FIG. 9 is a perspective view of the first halogen heater 50*a* and the second halogen heater 50*b*, illustrating a detailed construction thereof. As illustrated in FIG. 9, each of the first halogen heater 50*a* and the second halogen heater 50*b* is a filament lamp including a tubular glass tube 506 made of quartz glass or the like and a filament 505 made of tungsten or the like. The filament 505 is disposed inside the glass tube 506. A ring supporter 503 is disposed inside the glass tube 506 so that the filament 505 retains a desired shape. The supporter 503 is made of tungsten or the like.

The second halogen heater 50*b* includes a non-heat generating portion 502 disposed in a center of the second halogen heater 50*b* in the longitudinal direction thereof and a heat generating portion 501 disposed in each lateral end of the second halogen heater 50*b* in the longitudinal direction thereof. Conversely, the first halogen heater 50*a* includes the heat generating portion 501 disposed in a center of the first halogen heater 50*a* in the longitudinal direction thereof and the non-heat generating portion 502 disposed in each lateral end of the first halogen heater 50*a* in the longitudinal direction thereof. In the heat generating portion 501 of each of the first halogen heater 50*a* and the second halogen heater 50*b*, the filament 505 is coiled helically and densely throughout the entire span of the heat generating portion 501, thus creating luminous filaments (e.g., the first light emitting filament 51*a* and the second light emitting filament 51*b*) serving as heat generators, respectively.

Conversely, in the non-heat generating portion 502 of the second halogen heater 50*b*, the filament 505 is substantially straight. However, the filament 505 is coiled densely at the supporter 503. The filament 505 coiled densely at the supporter 503 is called a dead coil and supported by the supporter 503.

Conversely, a core bar 504 is disposed in the non-heat generating portion 502 of the first halogen heater 50*a*. The core bar 504 addressing short circuit is made of metal such as molybdenum. The filament 505 is coiled around the core bar 504. In the non-heat generating portion 502, the filament 505 is coiled densely at the supporter 503 disposed at each lateral end of the core bar 504 in the longitudinal direction of the first halogen heater 50*a*.

As described above, the first halogen heater 50*a* is substantially different from the second halogen heater 50*b* in that the non-heat generating portion 502 of the first halogen heater 50*a* has the core bar 504. The core bar 504 disposed in the non-heat generating portion 502 suppresses heat generation from dense coil portions of the filament 505 in the non-heat generating portion 502. For example, the core bar 504 decreases the electric resistance of the dense coil portions (e.g., the dead coils) of the filament 505, which are coiled at the supporters 503, in the non-heat generating portion 502 of the first halogen heater 50*a*, suppressing heat generation compared to heat generation from the dense coil portions (e.g., the dead coils) in the non-heat generating portion 502 of the second halogen heater 50*b*.

As described above, the core bar 504 disposed in the non-heat generating portion 502 of the first halogen heater 50*a* suppresses local heat generation from each lateral end span of the first halogen heater 50*a* in the longitudinal direction thereof. Accordingly, variation in the temperature of the fixing belt 38 is reduced, improving control of the temperature of the fixing belt 38. Additionally, the first halogen heater 50*a* suppresses redundant heat generation in the non-heat generating portion 502, decreasing power consumption of the first halogen heater 50*a*. Even if the first halogen heater 50*a* shares a common power supply with a lamp, a lighting. or the like, the first halogen heater 50*a* is immune from flicker. In addition to increased power consumption, a shortened control cycle (e.g., a shortened energization cycle) of the first halogen heater 50*a* causes the first halogen heater 50*a* to be susceptible to flicker. To address this circumstance, according to this embodiment, decreased power consumption of the first halogen heater 50*a* shortens the control cycle of the first halogen heater 50*a*, improving control of the temperature of the fixing belt 38.

Figure 10:
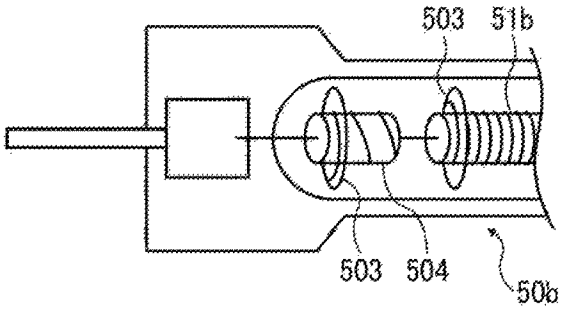
FIG. 10 is a partial perspective view of the second halogen heater depicted in FIG. 9.

FIG. 10 is a partial perspective view of the second halogen heater 50*b*. As illustrated in FIG. 10, the second halogen heater 50*b* may further include the supporter 503 situated in a non-heat generating portion disposed outboard from the heat generating portion 501 in the longitudinal direction of the second halogen heater 50*b*. If the second halogen heater 50*b* has a dense coil portion, the core bar 54 may be disposed in the non-heat generating portion disposed outboard from the heat generating portion 501 in the longitudinal direction of the second halogen heater 50*b*.

A description is provided of a construction of a first comparative fixing device.

Image forming apparatuses such as a copier, a printer, a facsimile machine, and a multifunction peripheral or a multifunction printer form a toner image on an image bearer (e.g., a photoconductor) according to image data. The toner image is transferred onto a recording medium such as paper and overhead projector (OHP) transparencies. While the recording medium bearing the toner image is conveyed through the first comparative fixing device, the first comparative fixing device fixes the toner image on the recording medium under heat and pressure.

The first comparative fixing device is requested to heat a heating member (e.g., a fixing belt) to a desired fixing temperature quickly so as to save energy and shorten a waiting time (e.g., a warm-up time) for a user to wait until a print job starts. To address this request to save energy and shorten the waiting time, the first comparative fixing device may include a thin belt, a thin film, or a thin roller that is heated by a halogen heater directly.

The first comparative fixing device includes the endless fixing belt having a thermal capacity smaller than a thermal capacity of a heating roller. A pressure pad and a reinforcement that supports the pressure pad are disposed inside a loop formed by the fixing belt. Thus, the first comparative fixing device shortens the waiting time and saves energy. As the image forming apparatus incorporating the first comparative fixing device is downsized, the fixing belt incorporated in the first comparative fixing device is downsized to have a decreased loop diameter that reduces an interval between a heat generator and the reinforcement and an interval between the heat generator and a reflector that are disposed inside the loop formed by the fixing belt. As the interval between the heat generator and the reflector decreases, an amount of radiant heat from the heat generator that is reflected by the reflector and passed through the heat generator increases, degrading heating efficiency of heating the fixing belt.

If the thickness of the reflector decreases to secure a sufficient interval between the heat generator and the reflector, the rigidity of the reflector decreases. Accordingly, the reflector may be bent in a longitudinal direction thereof due to its weight. In order to prevent the reflector from being bent, the reflector may be secured to or molded with the reinforcement.

Alternatively, the reinforcement may be interposed between a plurality of halogen heaters disposed inside the loop formed by the fixing belt to prevent the plurality of halogen heaters from heating each other. A reflection face of the reflector mounted on the reinforcement may have a gable disposed opposite the halogen heater at an intersection where a perpendicular defined by a center of the halogen heater and the reflection face intersects the reflection face.

Accordingly, the reflection face prevents radiant heat or light emitted from the halogen heater from irradiating the reflector substantially perpendicularly, thus preventing the radiant heat or light from being reflected by the reflector and heating the halogen heater. Consequently, the radiant hear or light reflected by the reflector heats the fixing belt. The intersection where the perpendicular intersects the reflection face corresponds to or overlaps a summit of the gable precisely to prevent the radiant heat or light from the halogen heater from irradiating the reflector substantially perpendicularly, thus preventing the radiant heat or light reflected by the reflector from heating the halogen heater.

In the first comparative fixing device incorporating the endless fixing belt that has the decreased thermal capacity and the pressure pad and the reinforcement that are situated inside the loop formed by the fixing belt, a pressure roller situated outside the loop formed by the fixing belt is pressed against the pressure pad via the fixing belt to form a fixing nip between the pressure roller and the fixing belt. The pressure pad and the reinforcement are exerted with pressure from the pressure roller throughout the entire width of the pressure pad and the reinforcement in a longitudinal direction thereof. Accordingly, the pressure pad and the reinforcement are bent in the longitudinal direction thereof. As the reinforcement is bent, the reflector mounted on the reinforcement is also bent, deviating the summit of the gable of the reflector from the center of the halogen heater and resulting in failure in improving heating efficiency of heating the fixing belt.

The reinforcement may be upsized to achieve an increased rigidity great enough to prevent bending. However, since the reinforcement is situated inside the loop formed by the fixing belt, it is difficult to upsize the reinforcement. To address this circumstance, the shape of the pressure pad and the reinforcement may be determined in view of allowable slight bending.

A description is provided of a construction of a comparative fixing device 9C.

Figure 11:
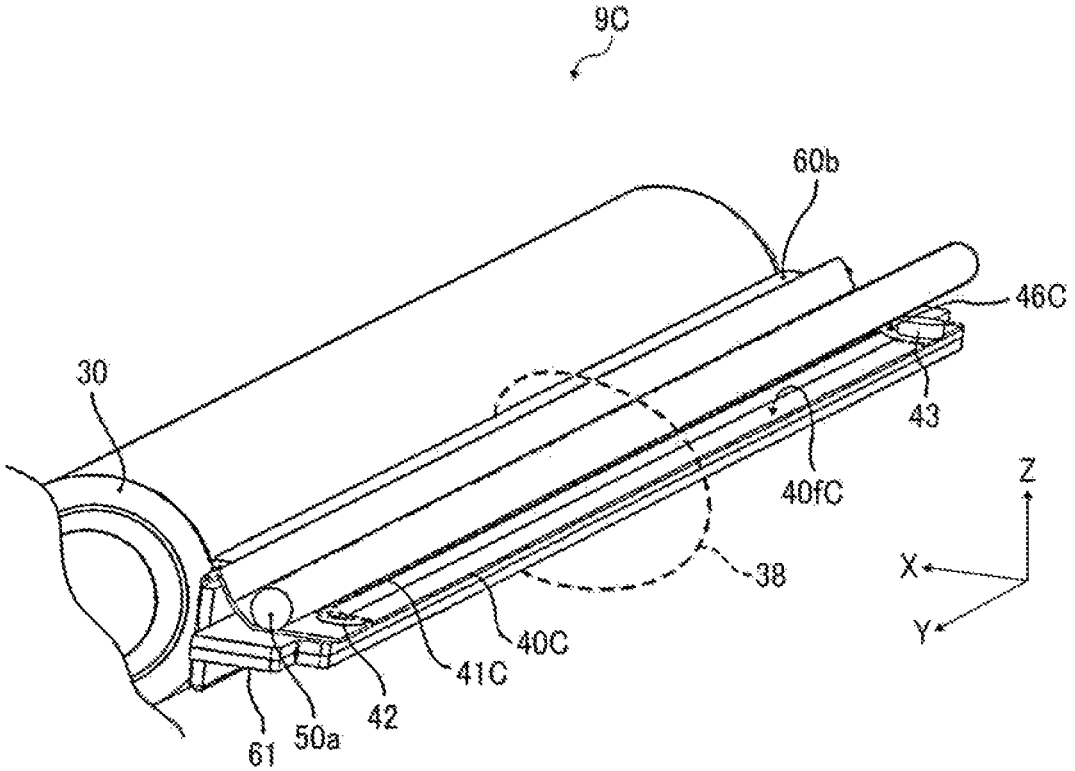
FIG. 11 is a perspective view of a comparative fixing device.
Figure 12A:
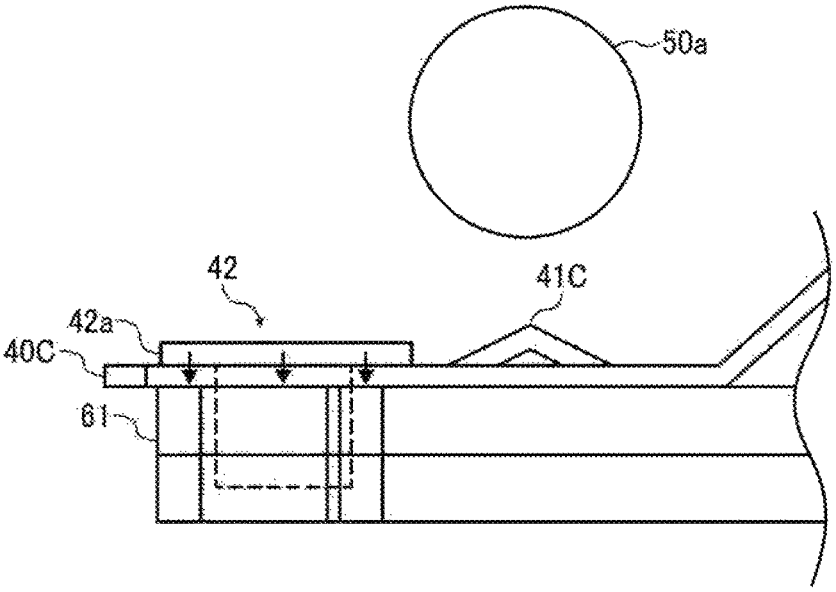
FIG. 12A is a schematic partial cross-sectional view of a reflector secured to a stay with a flat head screw of the comparative fixing device depicted in FIG. 11.
Figure 12B:
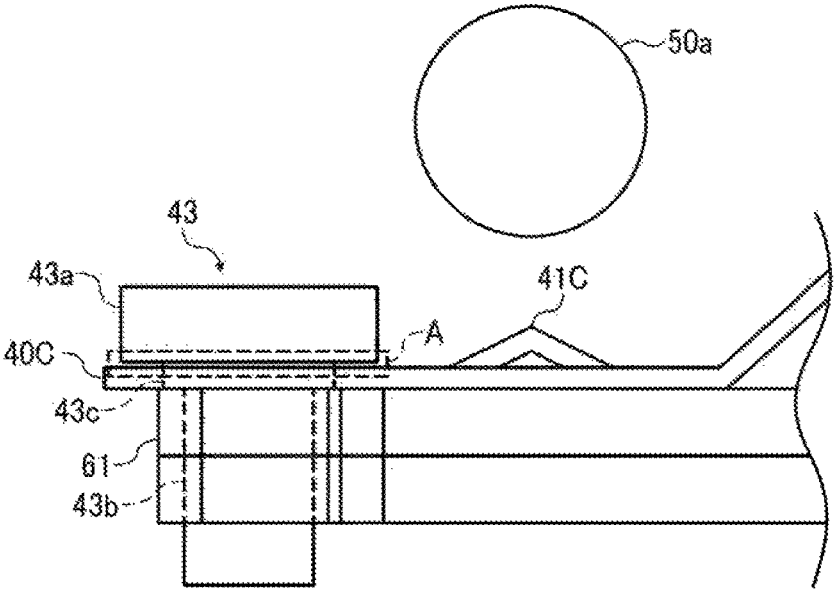
FIG. 12B is a schematic partial cross-sectional view of the reflector secured to the stay with a shoulder screw of the comparative fixing device depicted in FIG. 11.
Figure 13A:
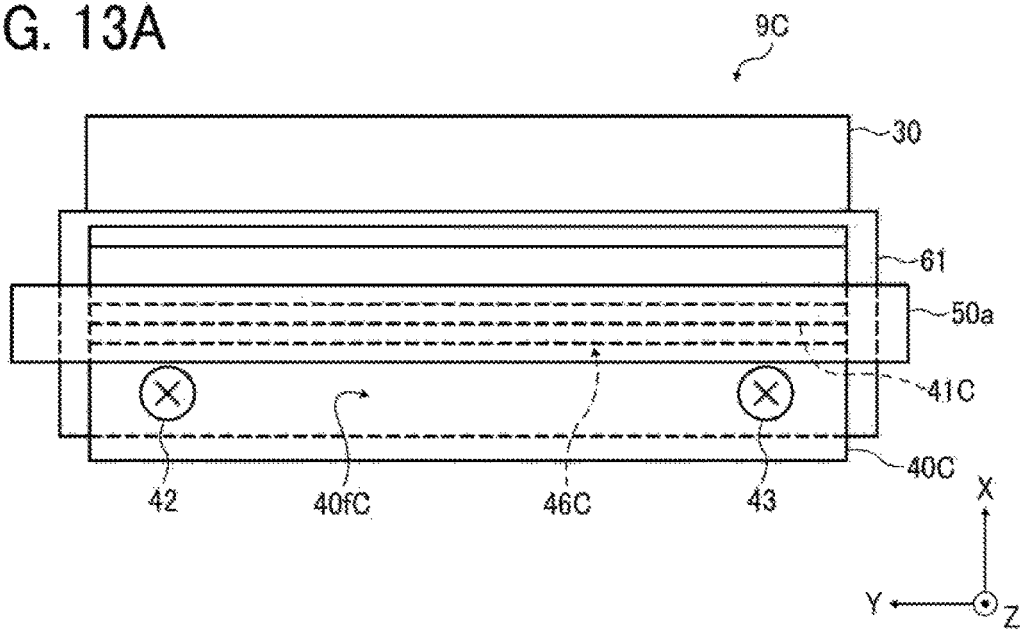
FIG. 13A is a schematic top view of the comparative fixing device depicted in FIG. 11, illustrating a depressurization state in which a pressure roller is not pressed against a fixing belt.
Figure 13B:
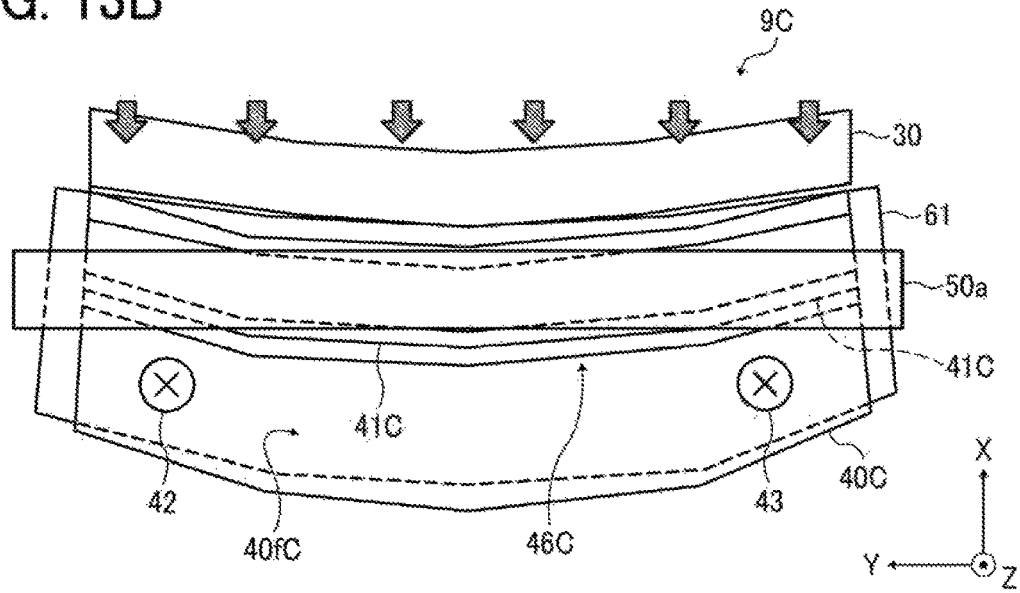
FIG. 13B is a schematic top view of the comparative fixing device depicted in FIG. 11, illustrating a pressurization state in which the pressure roller is pressed against the fixing belt.
Figure 14:
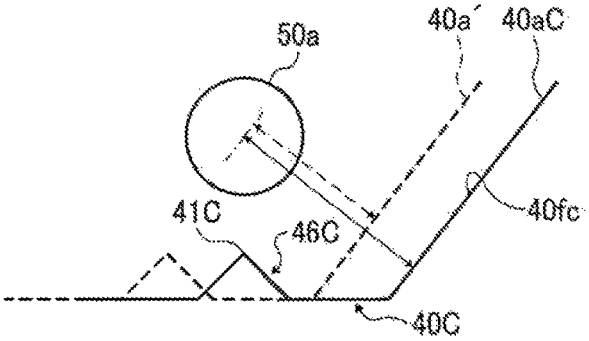
FIG. 14 is a schematic cross-sectional view of the reflector of the comparative fixing device depicted in FIG. 11 for explaining motion of the reflector in the pressurization state.

FIG. 11 is a perspective view of the comparative fixing device 9C. As illustrated in FIG. 11, the comparative fixing device 9C includes a reflector 40C secured to the stay 61 with a flat head screw 42 and a shoulder screw 43. FIG. 11 illustrates the comparative fixing device 9C from which the fixing belt 38 is removed. FIG. 11 illustrates a trajectory of the fixing belt 38 in a dotted line. FIG. 12A is a schematic partial cross-sectional view of the reflector 40C secured to the stay 61 with the flat head screw 42. FIG. 12B is a schematic partial cross-sectional view of the reflector 40C secured to the stay 61 with the shoulder screw 43. FIGS. 13A and 13B illustrate a schematic top view of the comparative fixing device 9C illustrating a top of the comparative fixing device 9C depicted in FIG. 11. FIG. 13A illustrates a depressurization state in which the pressure roller 30 is not pressed against the fixing belt 38. FIG. 13B illustrates a pressurization state in which the pressure roller 30 is pressed against the fixing belt 38. FIG. 14 is a schematic cross-sectional view of the reflector 40C of the comparative fixing device 9C for explaining motion of the reflector 40C in the pressurization state.

As illustrated in FIG. 11, the comparative fixing device 9C includes the reflector 40C supported by the stay 61. The reflector 40C is fastened to the stay 61 with the flat head screw 42 at one lateral end of the reflector 40C in a longitudinal direction thereof and the shoulder screw 43 at another lateral end of the reflector 40C in the longitudinal direction thereof. As illustrated in FIG. 13A, in the depressurization state, a summit 41C of a gable 46C of the reflector 40C corresponds to or overlaps the center of the first halogen heater 50*a* in a direction X perpendicular to the longitudinal direction of the stay 61. That is, the summit 41C of the gable 46C of the reflector 40C is disposed opposite the center of the first halogen heater 50*a*.

As illustrated in FIG. 12A, the reflector 40C is fastened to the stay 61 with the flat head screw 42 such that one lateral end of the reflector 40C in the longitudinal direction thereof is sandwiched between the stay 61 and a back face of a head 42*a* of the flat head screw 42. A fastening force of the flat head screw 42 generates a static friction force between the reflector 40C and the stay 61, which prevents the reflector 40C from moving relative to the stay 61 in any direction. Conversely, as illustrated in FIG. 12B, the reflector 40C is fastened to the stay 61 with the shoulder screw 43 such that another lateral end of the reflector 40C in the longitudinal direction thereof is interposed between the stay 61 and a back face of a head 43*a* of the shoulder screw 43 with a gap A between a surface of the reflector 40C and the back face of the head 43*a* of the shoulder screw 43.

The shoulder screw 43 includes a thread portion, that is, a thread 43*b*, screwed into the stay 61 to engage a thread of the stay 61; a tubular first non-thread portion; and a tubular second non-thread portion. The first non-thread portion is a shank 43*c* having a diameter greater than a diameter of the thread 43*b*. The shank 43*c* extends from one end face of the thread 43*b* and projects in a separation direction in which the shank 43*c* separates from the thread of the stay 61. The second non-thread portion is the head 43*a* having a diameter greater than the diameter of the shank 43*c*. The head 43*a* extends from an opposite face of the shank 43*c* which is opposite a face of the shank 43*c* which adjoins the thread 43*b*. The head 43*a* projects in a separation direction in which the head 43*a* separates from the thread of the stay 61.

The reflector 40C includes an elongate hole (e.g., a slot) elongated in a width direction, that is, the longitudinal direction of the reflector 40C. The shoulder screw 43 is inserted into the elongate hole of the reflector 40C. The shank 43*c* is disposed in the elongate hole of the reflector 40C. The diameter of the shank 43*c* is smaller than a diameter of the elongate hole of the reflector 40C. A length of the shank 43*c* is greater than a thickness of the reflector 40C. The diameter of the head 43*a* is greater than the diameter of the elongate hole of the reflector 40C.

As described above, since one lateral end of the reflector 40C in the longitudinal direction thereof is attached to the stay 61 with the shoulder screw 43, the reflector 40C is immune from the fastening force. Hence, when the reflector 40C expands thermally, the shoulder screw 43 causes the reflector 40C to expand toward the shoulder screw 43 in the longitudinal direction of the reflector 40C.

As illustrated in FIG. 13B, as the pressurization assembly biases and presses the pressure roller 30 against the fixing belt 38 in the pressurization state, the stay 61 is exerted with pressure from the pressure roller 30 through the fixing belt 38 and the pressure pad 60. As the stay 61 is exerted with pressure, the stay 61 is deformed and bent such that a center portion of the stay 61 in the longitudinal direction thereof separates from the pressure roller 30 such that the stay 61 pivots about each lateral end of the stay 61 in the longitudinal direction thereof, which is supported by the supporting side plate 70.

The reflector 40C supported by the stay 61 deforms similarly in accordance with deformation of the stay 61. For example, static friction generates between the stay 61 and a portion of the reflector 40C that is in proximity to each of the flat head screw 42 and the shoulder screw 43. The static friction causes the reflector 40C to deform in accordance with deformation of the stay 61. For example, the reflector 40C deforms such that the reflector 40C pivots about each of the flat head screw 42 and the shoulder screw 43 toward an interior of the fixing belt 38.

As the reflector 40C deforms, as illustrated in FIG. 14, a bent portion 40*a*C of a reflection face 40*f*C of the reflector 40C moves as described below in accordance with deformation of the reflector 40C. The bent portion 40*a*C is bent at a predetermined angle relative to a pressurization direction in which the pressure roller 30 is pressed against the fixing belt 38. For example, as indicated by a dotted line 40*a*', the bent portion 40*a*C moves toward the first halogen heater 50*a* compared to a position of the bent portion 40*a*C before deformation of the reflector 40C. If a distance between the reflector 40C and the first halogen heater 50*a* is small, light radiated from the first halogen heater 50*a* and reflected by the bent portion 40*a*C of the reflector 40C penetrates through the first halogen heater 50*a* in an increased amount, degrading heating efficiency of heating the fixing belt 38.

As the reflector 40C deforms, the summit 41C of the gable 46C is displaced such that a center portion of the summit 41C in the longitudinal direction of the reflector 40C separates away from the pressure roller 30. Accordingly, the summit 41C of the gable 46C of the reflector 40C deviates substantially from the center of the first halogen heater 50*a* in a direction perpendicular to a longitudinal direction of the comparative fixing device 9C. Consequently, the reflection face 40*f*C of the reflector 40C may not reflect radiant heat or light irradiating the reflection face 40*f*C toward the fixing belt 38 without directing the radiant heat or light to the first halogen heater 50*a*, degrading heating efficiency of heating the fixing belt 38. Although failures of the comparative fixing device 9C are described above with reference to the first halogen heater 50*a*, similar failures may occur with the second halogen heater 50*b* disposed opposite the first halogen heater 50*a* via the stay 61.

A description is provided of a configuration of the fixing device 9S to address the failures of the comparative fixing device 9C.

Figure 15:
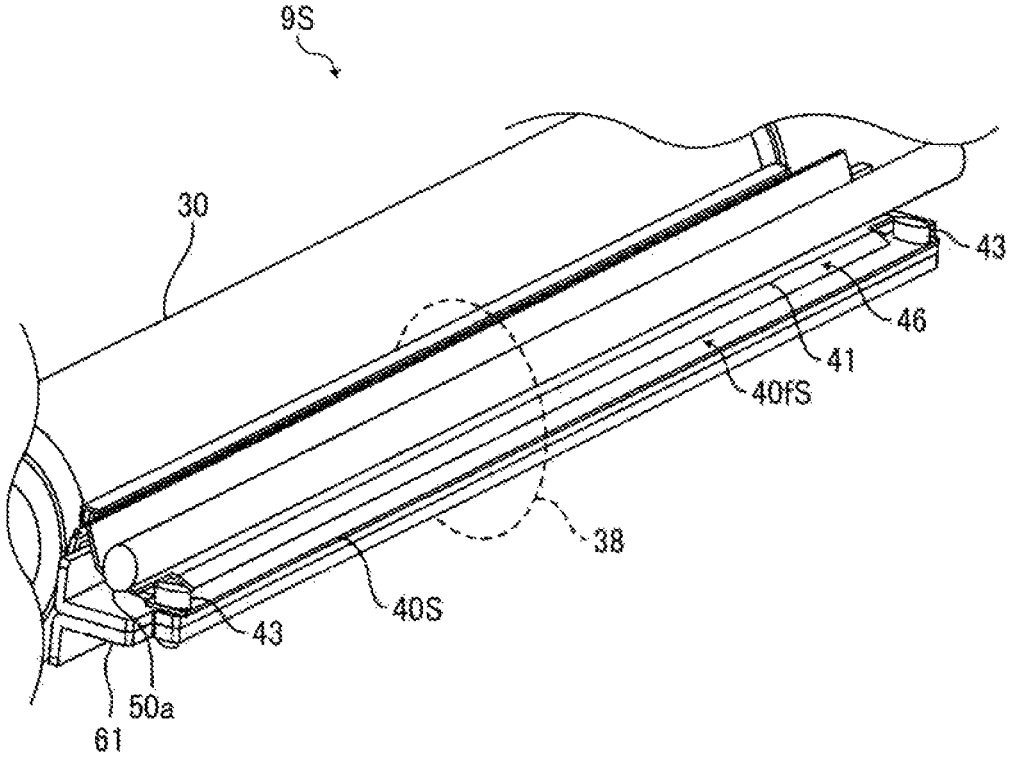
FIG. 15 is a partial perspective view of the fixing device depicted in FIG. 3.

FIG. 15 is a partial perspective view of the fixing device 9S. As illustrated in FIG. 15, each lateral end of the reflector 40S in a longitudinal direction thereof is supported by the stay 61 through the shoulder screw 43 serving as a fastener. Since the fixing device 9S employs the shoulder screw 43 used by the comparative fixing device 9C, of which construction is described above with reference to FIG. 12B, a description of the shoulder screw 43 is omitted.

Figure 16A:
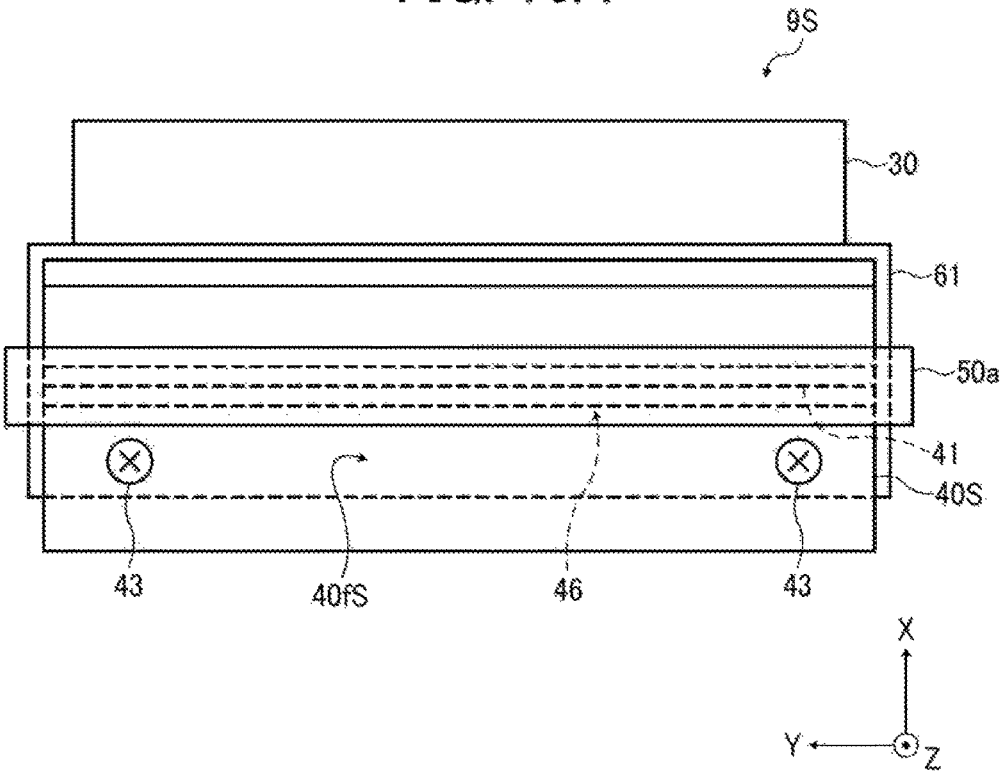
FIG. 16A is a top view of the fixing device depicted in FIG. 15 in the depressurization state in which the pressure roller is not pressed against the fixing belt.
Figure 16B:
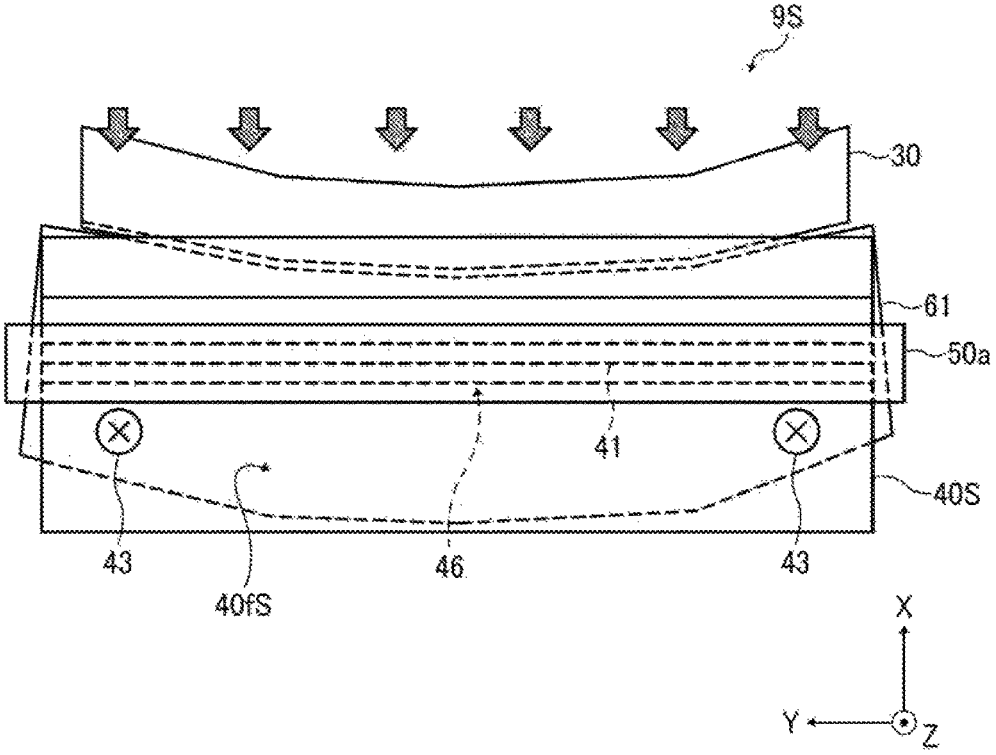
FIG. 16B is a top view of the fixing device depicted in FIG. 15 in the pressurization state in which the pressure roller is pressed against the fixing belt.

FIG. 16A is a top view of the fixing device 9S in the depressurization state in which the pressure roller 30 is not pressed against the fixing belt 38. FIG. 16B is a top view of the fixing device 9S in the pressurization state in which the pressure roller 30 is pressed against the fixing belt 38.

As illustrated in FIG. 16A, in the depressurization state, the summit 41 of the gable 46 of the reflector 40S corresponds to or overlaps the center of the first halogen heater 50*a* in the direction X perpendicular to the longitudinal direction of the stay 61 or a longitudinal direction of the fixing device 9S. That is, the summit 41 of the gable 46 of the reflector 40S is disposed opposite the center of the first halogen heater 50*a*.

As illustrated in FIG. 16B, when the pressurization assembly presses the pressure roller 30 against the fixing belt 38 in the pressurization state, the stay 61 is exerted with pressure from the pressure roller 30. As the stay 61 is exerted with pressure, like the stay 61 of the comparative fixing device 9C, the stay 61 is deformed and bent such that the center portion of the stay 61 in the longitudinal direction thereof separates from the pressure roller 30 such that the stay 61 pivots about each lateral end of the stay 61 in the longitudinal direction thereof, which is supported by the supporting side plate 70.

With the fixing device 9S according to this embodiment, each lateral end of the reflector 40S in the longitudinal direction thereof is attached to the stay 61 with the shoulder screw 43. A fastening force of the shoulder screws 43 generates a static friction force between the reflector 40S and the stay 61. The shoulder screws 43 decrease the static friction force substantially compared to the flat head screw 42 and the shoulder screw 43 of the comparative fixing device 9C, preventing the reflector 40S from deforming in accordance with deformation of the stay 61. Hence, a distance between the first halogen heater 50*a* and a bent portion 40*a* depicted in FIG. 3 of the reflector 40S is constant. Accordingly, the summit 41 of the gable 46 of the reflector 40S does not deviate from the center of the first halogen heater 50*a*, thus retaining heating efficiency of heating the fixing belt 38. Consequently, radiant heat or light radiated from the first halogen heater 50*a* does not irradiate the reflection face 40*f*S of the reflector 40S substantially perpendicularly.

The reflection face 40*f*S of the reflector 40S constantly reflects the radiant heat or light irradiating the reflector 40S toward the fixing belt 38 without directing the radiant heat or light to the first halogen heater 50*a*, thus preventing the radiant heat or light from penetrating through the first halogen heater 50*a* and retaining heating efficiency of heating the fixing belt 38. The fixing device 9S retaining heating efficiency of heating the fixing belt 38 allows the entire image forming apparatus 500 to decrease energy consumption, saving energy.

A description is provided of a plurality of variations of the reflector 40S.

Figure 17:
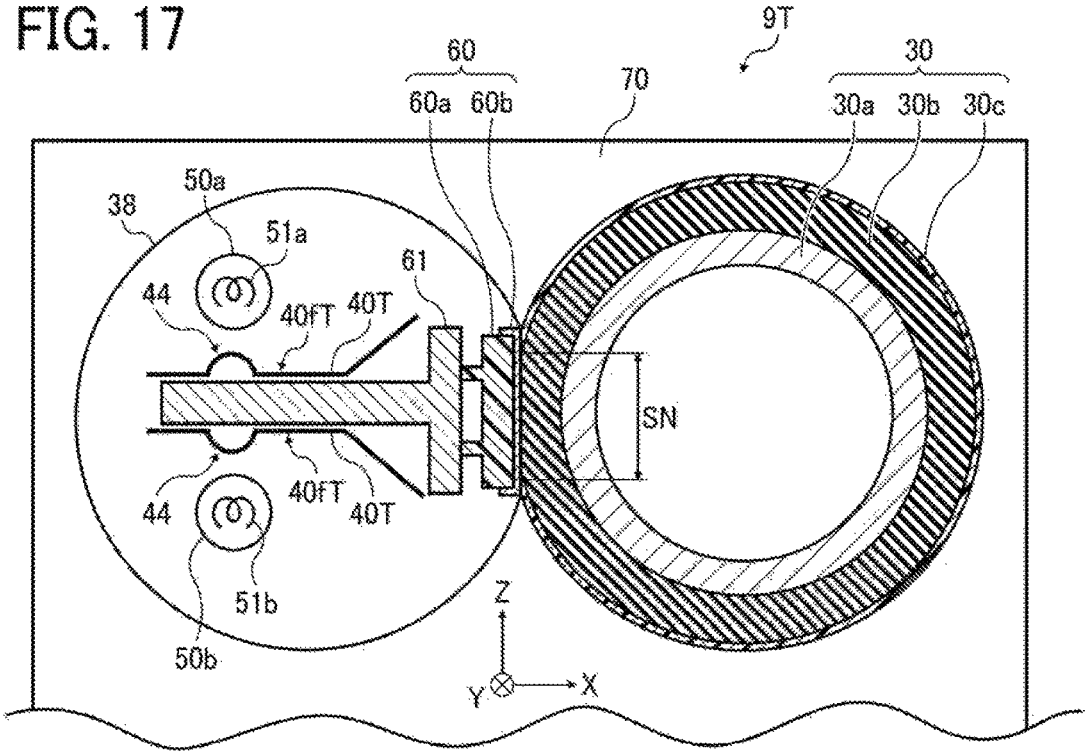
FIG. 17 is a schematic vertical cross-sectional view of a fixing device incorporating a reflector as a first variation of the reflector depicted in FIG. 3.
Figure 18:
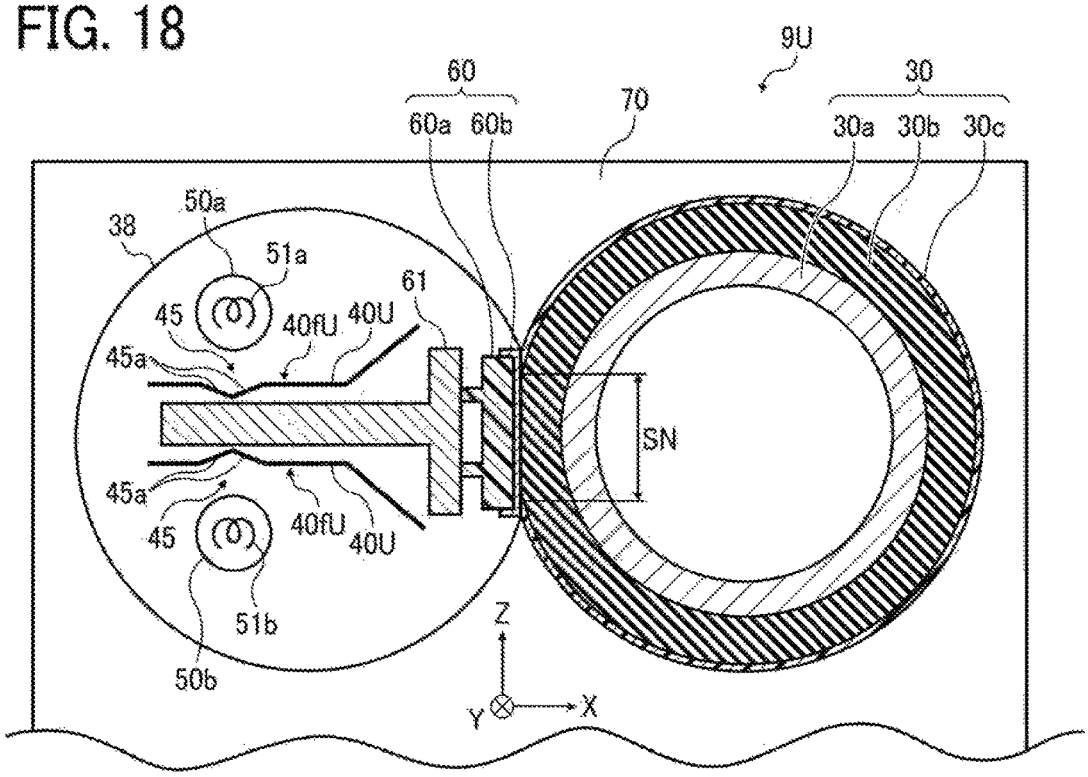
FIG. 18 is a schematic vertical cross-sectional view of a fixing device incorporating a reflector as a second variation of the reflector depicted in FIG. 3.

FIG. 17 is a schematic vertical cross-sectional view of a fixing device 9T incorporating a reflector 40T as a first variation of the reflector 40S. FIG. 18 is a schematic vertical cross-sectional view of a fixing device 9U incorporating a reflector 40U as a second variation of the reflector 40S. Instead of the reflection face 40*f*S of the reflector 40S, the reflectors 40T and 40U include reflection faces 40*f*T and 40*f*U, respectively, each of which has a shape, other than the gable 46, to reflect radiant heat or light radiated from the first halogen heater 50*a* and the second halogen heater 50*b* in the reflection direction different from the incident direction of the radiant heat or light.

Since the reflectors 40T and 40U share a common configuration with the reflector 40S except for the shape of the opposed portion of the reflector 40S that is disposed opposite each of the first halogen heater 50*a* and the second halogen heater 50*b*, the following describes a configuration of the reflectors 40T and 40U that is different from the configuration of the reflector 40S.

As illustrated in FIG. 17, the reflector 40T of the fixing device 9T includes an arch 44 disposed opposite and bulged or projected toward each of the first halogen heater 50*a* and the second halogen heater 50*b*. An outer circumferential surface of the arch 44 is perpendicular to the incident direction of radiant heat or light radiated from the first halogen heater 50*a* and the second halogen heater 50*b* in a limited area on the outer circumferential surface of the arch 44. Accordingly, the outer circumferential surface of the arch 44 reflects the radiant heat or light radiated from the first halogen heater 50*a* and the second halogen heater 50*b* in the reflection direction different from the incident direction of the radiant heat or light in an area other than the limited area on the outer circumferential surface of the arch 44. Consequently, similarly with the reflection face 40*f*S of the reflector 40S incorporated in the fixing device 9S, the reflection face 40*f*T of the reflector 40T reflects the radiant heat or light irradiating the reflection face 40*f*T toward the fixing belt 38, not toward the first halogen heater 50*a* and the second halogen heater 50*b*, preventing the radiant heat or light from penetrating through the first halogen heater 50*a* and the second halogen heater 50*b*.

As illustrated in FIG. 18, the reflector 40U of the fixing device 9U includes a recess 45 disposed opposite and recessed with respect to each of the first halogen heater 50*a* and the second halogen heater 50*b*. Since the incident direction of radiant heat or light radiated from the first halogen heater 50*a* and the second halogen heater 50*b* is not perpendicular to slopes 45*a* of the recess 45, the radiant heat or light is reflected by the recess 45 in the reflection direction different from the incident direction. Consequently, similarly with the reflection face 40*f*S of the reflector 40S incorporated in the fixing device 9S, the reflection face 40*f*U of the reflector 40U reflects the radiant heat or light irradiating the reflection face 40*f*U toward the fixing belt 38, not toward the first halogen heater 50*a* and the second halogen heater 50*b*, preventing the radiant heat or light from penetrating through the first halogen heater 50*a* and the second halogen heater 50*b*. If the two slopes 45*a* of the recess 45 define a right angle, the slopes 45*a* may reflect radiant heat or light radiated from the first halogen heater 50*a* and the second halogen heater 50*b* in a direction opposite the incident direction of the radiant heat or light. To address this circumstance, it is preferable that the two slopes 45*a* do not define the right angle.

Figure 19:
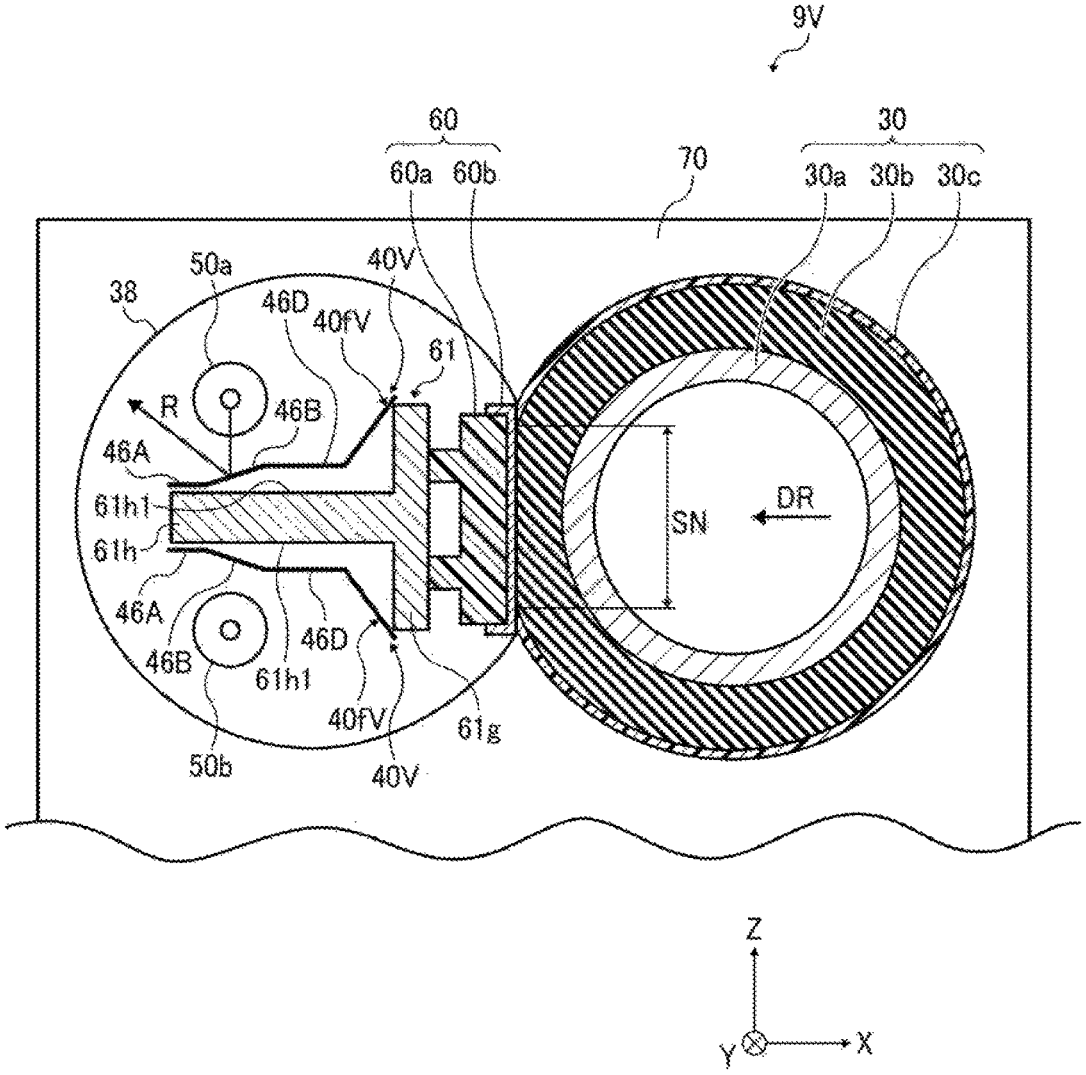
FIG. 19 is a schematic vertical cross-sectional view of a fixing device incorporating a reflector as a third variation of the reflector depicted in FIG. 3.

FIG. 10 is a schematic vertical cross-sectional view of a fixing device 9V incorporating a reflector 40V as a third variation of the reflector 40S. As illustrated in FIG. 19, the reflector 40V includes a reflection face 40*f*V including, as a shape that reflects radiant heat or light radiated from the first halogen heater 50*a* and the second halogen heater 50*b* in the reflection direction different from the incident direction of the radiant heat or light, two parallel planes that are unevenly parallel to the stay 61 and a tilt plane that bridges the two parallel planes. Since the reflector 40V shares a common configuration with the reflector 40S except for the shape of the reflector 40V, the following describes a configuration of the reflector 40V that is different from the configuration of the reflector 40S.

As illustrated in FIG. 19, the stay 61 includes a base 61*g* and an arm 61*h* projecting from the base 61*g* in a direction perpendicular to the longitudinal direction of the stay 61. That is, the arm 61*h* projects with respect to the pressure pad 60 to support the pressure pad 60 against pressure from the pressure roller 30 exerted in a pressurization direction DR. The two reflectors 40V cover the arm 61*h* of the stay 61. The reflector 40V includes, as the two parallel planes, a first reflection plane 46A and a third reflection plane 46D that are unevenly parallel to the stay 61. The reflector 40V further includes a second reflection plane 46B that is tilted relative to the first reflection plane 46A and the third reflection plane 46D and bridges the first reflection plane 46A and the third reflection plane 46D.

The two halogen heaters, that is, the first halogen heater 50*a* and the second halogen heater 50*b*, are disposed opposite the second reflection planes 46B, respectively. An incidence angle of the radiant heat or light that irradiates the second reflection plane 46B is not perpendicular to the second reflection plane 46B. Accordingly, the second reflection plane 46B reflects the radiant heat or light in the reflection direction different from the incident direction of the radiant heat or light, thus preventing the radiant heat or light reflected by the second reflection plane 46B from irradiating each of the first halogen heater 50*a* and the second halogen heater 50*b*. Hence, the radiant heat or light being radiated from each of the first halogen heater 50*a* and the second halogen heater 50*b* and irradiating the second reflection plane 46B is reflected by the second reflection plane 46B in a reflection direction R, thus not being directed to each of the first halogen heater 50*a* and the second halogen heater 50*b* and being directed to a circumferential span of the fixing belt 38 that is disposed opposite the pressure pad 60 via the stay 61. Consequently, the second reflection plane 46B prevents the reflected heat or light from being directed to and heating the glass tube 506 depicted in FIG. 9 or the like of each of the first halogen heater 50*a* and the second halogen heater 50*b*, improving heating efficiency of heating the fixing belt 38.

A description is provided of a variation of attachment of the reflector 40V to the stay 61.

Figure 20A:
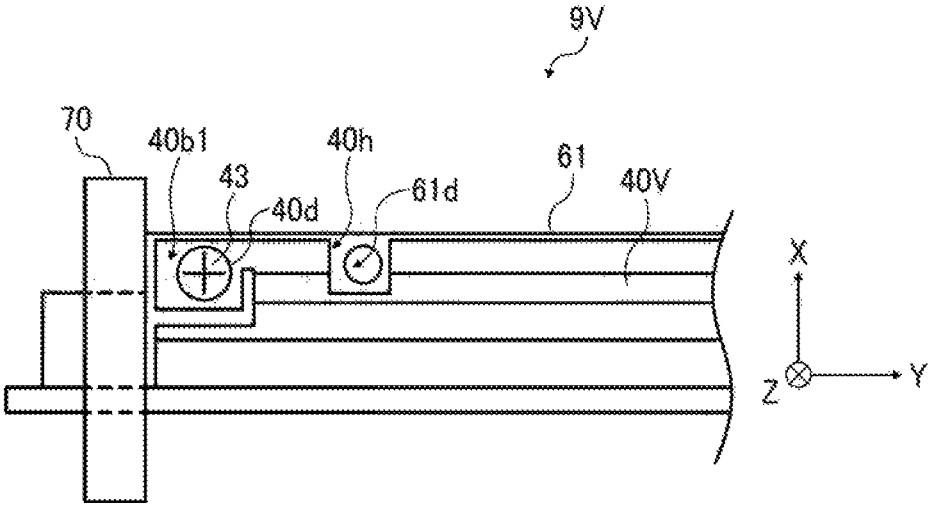
FIG. 20A is a partial schematic plan view of the fixing device depicted in FIG. 19, illustrating one lateral end of the reflector in a longitudinal direction thereof.
Figure 20B:
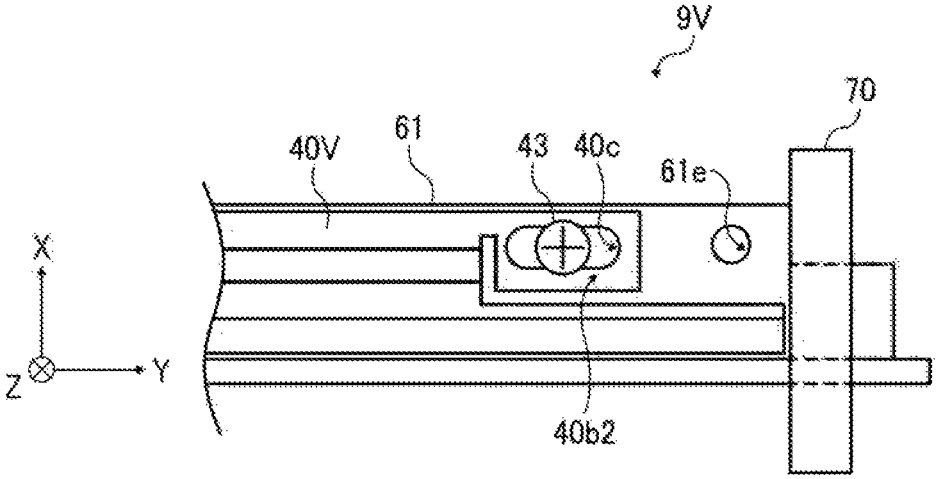
FIG. 20B is a partial schematic plan view of the fixing device depicted in FIG. 19, illustrating another lateral end of the reflector in the longitudinal direction thereof.
Figure 21A:
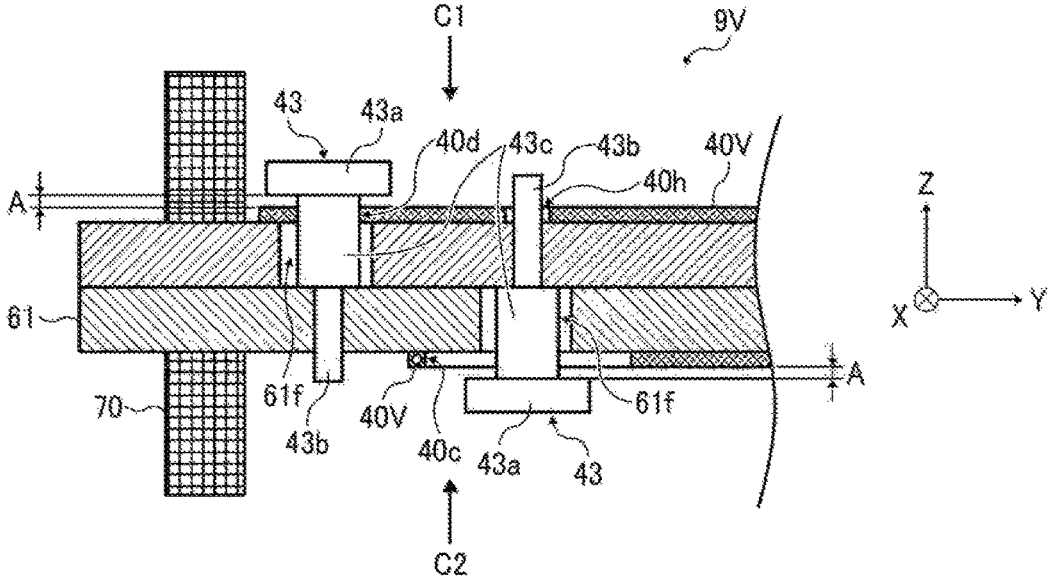
FIG. 21A is a partial schematic cross-sectional view of the fixing device depicted in FIG. 19, illustrating one lateral end of the reflector in the longitudinal direction thereof.
Figure 21B:
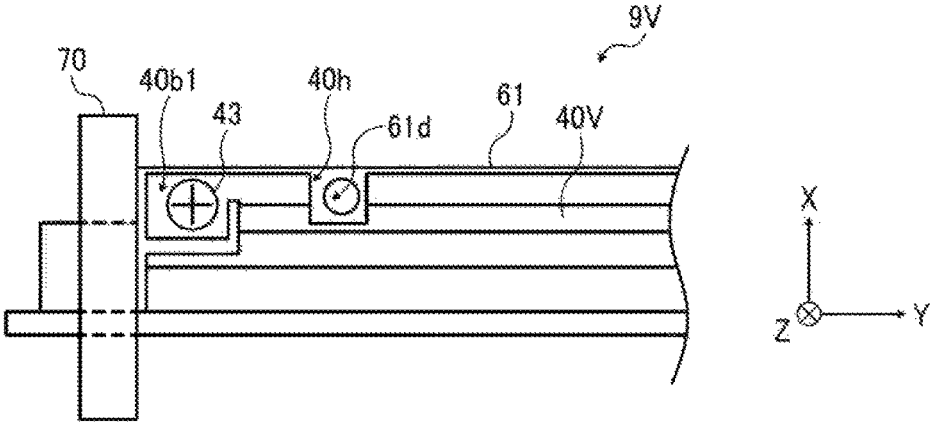
FIG. 21B is a partial schematic top view of the fixing device depicted in FIG. 21A seen in a direction C1 in FIG. 21A.
Figure 21C:
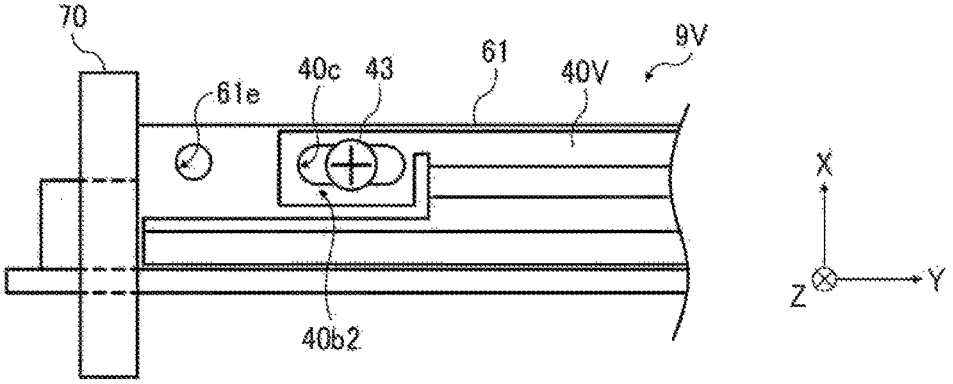
FIG. 21C is a partial schematic bottom view of the fixing device depicted in FIG. 21A seen in a direction C2 in FIG. 21A.

FIG. 20A is a partial schematic plan view of the fixing device 9V, illustrating one lateral end of the reflector 40V in a longitudinal direction thereof, which is attached to the stay 61. FIG. 20B is a partial schematic plan view of the fixing device 9V, illustrating another lateral end of the reflector 40V in the longitudinal direction thereof, which is attached to the stay 61. FIG. 21A is a partial schematic cross-sectional view of the fixing device 9V, illustrating one lateral end of the reflector 40V in the longitudinal direction thereof, which is attached to the stay 61. FIG. 21B is a partial schematic top view of the fixing device 9V seen in a direction C1 in FIG. 21A. FIG. 21C is a partial schematic bottom view of the fixing device 9V seen in a direction C2 in FIG. 21A. The variation of attachment of the reflector 40V to the stay 61 illustrated in FIGS. 20A, 20B, 21A, 21B, and 21C uses the reflector 40V depicted in FIG. 19.

As illustrated in FIG. 21A, the stay 61 includes a recess 61*f* accommodating the shank 43*c* of the shoulder screw 43. A thickness of the shank 43*c* (e.g., a length of the shank 43*c* in a direction Z) is greater than a combined length of a depth of the recess 61*f* and a thickness of the reflector 40V. Hence, also illustrated in FIG. 21A, also in the variation of attachment of the reflector 40V to the stay 61, the predetermined gap A is provided between the head 43*a* of the shoulder screw 43 and the reflector 40V.

Accordingly, also in the variation of attachment of the reflector 40V to the stay 61, the shoulder screw 43 is used as a fastener that fastens the reflector 40V to the stay 61. The gap A is provided between the head 43*a* of the shoulder screw 43 and the reflector 40V, preventing the reflector 40V from deforming in accordance with deformation of the stay 61. Consequently, the reflector 40V prevents a part of the radiant heat or light reflected by the reflector 40V from being directed to each of the first halogen heater 50*a* and the second halogen heater 50*b*, thus retaining heating efficiency of heating the fixing belt 38.

The gap A is 0.5 mm or smaller, preferably in a range of from 0.2 mm to 0.3 mm. If the gap A exceeds 0.5 mm, the reflector 40V may jolt substantially in the direction Z and may tilt relative to an opposed face of the stay 61, which is disposed opposite the reflector 40V. If the reflector 40V tilts, the reflector 40V does not reflect the radiant heat or light radiated from each of the first halogen heater 50*a* and the second halogen heater 50*b* evenly in the axial direction of the fixing belt 38, that is, the direction Y, causing variation in the temperature of the fixing belt 38 in the axial direction thereof. To address this circumstance, the gap A is 0.5 mm or smaller to prevent the reflector 40V from being tilted relative to the opposed face of the stay 61, which is disposed opposite the reflector 40V, thus suppressing variation in the temperature of the fixing belt 38 in the axial direction thereof.

As illustrated in FIGS. 20A and 20B, the reflector 40V includes attachment portions 40*b*1 and 40*b*2 attached to the stay 61 with the shoulder screws 43, respectively. The attachment portions 40*b*1 and 40*b*2 are disposed at both lateral ends of the reflector 40V in the longitudinal direction thereof, respectively. As illustrated in FIG. 20A, the attachment portion 40*b*1 disposed at one lateral end of the reflector 40V in the longitudinal direction thereof includes a circular, round hole 40*d* through which the shoulder screw 43 penetrates. As illustrated in FIG. 21A, a diameter of the round hole 40*d* is substantially equal to the diameter of the shank 43*c* of the shoulder screw 43. As illustrated in FIG. 20B, the attachment portion 40*b*2 disposed at another lateral end of the reflector 40V in the longitudinal direction thereof includes an elongate hole 40*c* that extends in the longitudinal direction of the reflector 40V.

As illustrated in FIG. 21A, as the shoulder screw 43 is penetrated through the round hole 40*d* and is screwed into the screw hole 61*e* depicted in FIG. 8 of the stay 61, the reflector 40V is positioned relative to the stay 61 in the direction X (e.g., a short direction of the reflector 40V) and the direction Y (e.g., the longitudinal direction of the reflector 40V). As illustrated in FIG. 20B, a short diameter in the direction X of the elongate hole 40*c* extending in the longitudinal direction of the reflector 40V is substantially equal to the diameter of the shank 43*c* of the shoulder screw 43. As the shoulder screw 43 is penetrated through the elongate hole 40*c* and screwed into the screw hole 61*d* depicted in FIG. 8 of the stay 61, the reflector 40V is positioned relative to the stay 61 in the direction Z. As illustrated in FIGS. 20A, and 20B, as a part of the head 43*a* of the shoulder screw 43 penetrating through the elongate hole 40*c* and a part of the head 43*a* of the shoulder screw 43 penetrating through the round hole 40*d* are disposed opposite the reflector 40V, the reflector 40V is positioned and secured relative to the stay 61 in the direction Z.

Also in the variation of attachment of the reflector 40V to the stay 61, one of holes through which the shoulder screws 43 disposed at both lateral ends of the reflector 40V in the longitudinal direction thereof penetrate is the elongate hole 40*c* extending in the longitudinal direction of the reflector 40V. Accordingly, when radiant heat or the like radiated from the first halogen heater 50*a* and the second halogen heater 50*b* increases the temperature of the reflector 40V and expands the reflector 40V thermally, the elongate hole 40*c* moves and slides relative to the shoulder screw 43 toward one lateral end of the reflector 40V in the longitudinal direction thereof, allowing or releasing thermal expansion of the reflector 40V. Consequently, the reflector 40V is not bent by thermal expansion such that a center of the reflector 40V in the longitudinal direction thereof separates from the opposed face of the stay 61, which is disposed opposite the reflector 40V.

According to this variation of attachment of the reflector 40V to the stay 61, the reflector 40V is attached to the stay 61 at a single position in the short direction of the reflector 40V, that is, the direction X. Accordingly, the reflector 40V is not bent by thermal expansion such that the center of the reflector 40V in the longitudinal direction thereof separates from the opposed face of the stay 61, which is disposed opposite the reflector 40V, while the reflector 40V is allowed to expand thermally in the short direction of the reflector 40V.

Another one of the holes through which the shoulder screws 43 disposed at both lateral ends of the reflector 40V in the longitudinal direction thereof penetrate is the round hole 40*d* having the diameter being substantially equal to the diameter of the shank 43*c* of the shoulder screw 43. Accordingly, the reflector 40V is attached to the stay 61 precisely in the longitudinal direction (e.g., the direction Y) and the short direction (e.g., the direction X) of the reflector 40V.

According to this variation of attachment of the reflector 40V to the stay 61, a first shoulder screw (e.g., the shoulder screw 43) fastens the reflector 40V to the first face, that is, the upper face or the downstream face of the stay 61 in the sheet conveyance direction DS depicted in FIGS. 2 and 3. A second shoulder screw (e.g., the shoulder screw 43) fastens the reflector 40V to the second face, that is, the lower face or the upstream face of the stay 61 in the sheet conveyance direction DS depicted in FIGS. 2 and 3. A first attachment position where the first shoulder screw fastens the reflector 40V to the first face of the stay 61 is shifted from a second attachment position where the second shoulder screw fastens the reflector 40V to the second face of the stay 61 in the longitudinal direction (e.g., the direction Y) of the reflector 40V so that the first shoulder screw and the second shoulder screw do not interfere with each other. For example, the second attachment position where the shoulder screw 43 penetrates through the elongate hole 40*c* is disposed inboard from the first attachment position where the shoulder screw 43 penetrates through the round hole 40*d* in the longitudinal direction of the reflector 40V. That is, the second attachment position is closer to the center of the reflector 40V than the first attachment position is.

As illustrated in FIG. 20A, the attachment portion 40*b*1 of the reflector 40V, which has the round hole 40*d*, includes a relief 40*h* (e.g., a notch) that releases the thread 43*b* of the shoulder screw 43 penetrating through the elongate hole 40*c*. The shoulder screw 43 penetrating through the round hole 40*d* of the reflector 40V is fastened to the screw hole 61*e* of the stay 61. The shoulder screw 43 penetrating through the elongate hole 40*c* of the reflector 40V is fastened to the screw hole 61*d* of the stay 61, which is disposed inboard from the screw hole 61*e* in the longitudinal direction of the reflector 40V.

According to this variation of attachment of the reflector 40V to the stay 61, as illustrated in FIGS. 20A and 20B, the reflector 40V attached to the first face of the stay 61 has the attachment portion 40*b*1 being provided with the round hole 40*d* and situated at one lateral end of the reflector 40V in the longitudinal direction thereof. The reflector 40V attached to the first face of the stay 61 has the attachment portion 40*b*2 being provided with the elongate hole 40*c* and situated at another lateral end of the reflector 40V in the longitudinal direction thereof. Conversely, the reflector 40V attached to the second face of the stay 61 has the attachment portion 40*b*2 being provided with the elongate hole 40*c* and situated at one lateral end of the reflector 40V in the longitudinal direction thereof. The reflector 40V attached to the second face of the stay 61 has the attachment portion 40*b*1 being provided with the round hole 40*d* and situated at another lateral end of the reflector 40V in the longitudinal direction thereof. Hence, the reflector 40V attached to the first face of the stay 61 and the reflector 40V attached to the second face of the stay 61 share identical parts, reducing manufacturing costs.

As illustrated in FIGS. 20A and 20B, according to this variation of attachment of the reflector 40V to the stay 61, the attachment portions 40*b*1 and 40*b*2 are disposed on a distal portion of the reflector 40V that is distal to the pressure pad 60, that is, an upper portion of the reflector 40V in FIGS. 20A and 20B. Alternatively, the attachment portions 40*b*1 and 40*b*2 may be disposed on a proximal portion of the reflector 40V that is proximal to the pressure pad 60.

Figure 22:
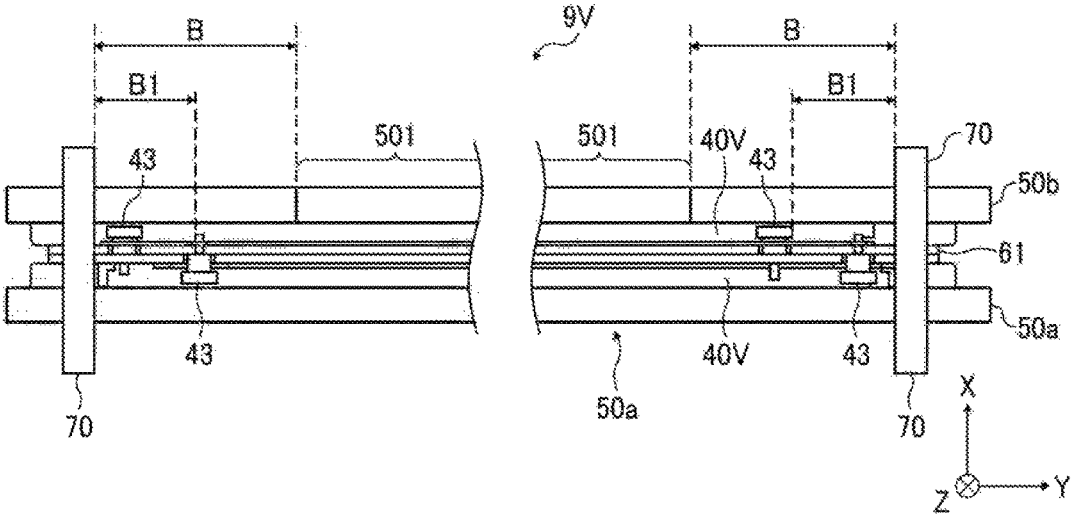
FIG. 22 is a cross-sectional side view of the fixing device depicted in FIG. 21A for explaining an attachment position of the reflector attached to a stay.

FIG. 22 is a cross-sectional side view of the fixing device 9V for explaining an attachment position of the reflector 40V attached to the stay 61. FIG. 22 omits illustration of the heat generating portion 501 of the first halogen heater 50*a*.

As illustrated in FIG. 22, according to this variation of attachment of the reflector 40V to the stay 61, the reflector 40V is attached to the stay 61 at the attachment position disposed in a lateral end span B disposed outboard from a most outboard heat generating portion, that is, the heat generating portion 501 of the second halogen heater 50*b*, and disposed inboard from the supporting side plate 70 in the longitudinal direction of the reflector 40V. That is, the attachment position is away from the center of the reflector 40V than the heat generating portion 501 and is closer to the center of the reflector 40V than the supporting side plate 70 in the longitudinal direction of the reflector 40V. The attachment position where the reflector 40V is attached to the stay 61 is disposed outboard from the most outboard heat generating portion, that is, the heat generating portion 501 of the second halogen heater 50*b* in the longitudinal direction of the reflector 40V, thus preventing radiant heat or light radiated from the first halogen heater 50*a* and the second halogen heater 50*b* from irradiating the shoulder screws 43. Thus, the reflector 40V is immune from decrease in reflecting efficiency of reflecting the radiant heat or light.

If the attachment position where the reflector 40V is attached to the stay 61 is disposed outboard from the supporting side plate 70 in the longitudinal direction of the reflector 40V, when the engaging portion 61*a* of the stay 61 depicted in FIG. 6 penetrates through the engaging hole 70*b* of the supporting side plate 70 depicted in FIG. 6 while the reflector 40V is fastened to the stay 61 with the shoulder screw 43, the head 43*a* of the shoulder screw 43 may be caught by the engaging hole 70*b*. Accordingly, the engaging portion 61*a* may not penetrate through the engaging hole 70*b* smoothly, degrading assembly of the stay 61 and the supporting side plate 70. If the reflector 40V is attached to the stay 61 after the engaging portion 61*a* penetrates through the engaging hole 70*b*, the reflector 40V need to penetrate through the engaging hole 70*b* that provides a clearance reduced by the stay 61 that has penetrated through the engaging hole 70*b*. Accordingly, the reflector 40V may not penetrate readily through the engaging hole 70*b* through which the engaging portion 61*a* has penetrated, degrading assembly of the stay 61 and the supporting side plate 70.

If the attachment position where the reflector 40V is attached to the stay 61 is disposed outboard from the supporting side plate 70 in the longitudinal direction of the reflector 40V, a length of the reflector 40V in the longitudinal direction thereof need to be greater than a distance between the pair of supporting side plates 70, increasing manufacturing costs of a material of the reflector 40V.

To address those circumstances, according to this variation of attachment of the reflector 40V to the stay 61, the attachment position where the reflector 40V is attached to the stay 61 is disposed inboard from the supporting side plate 70 in the longitudinal direction of the reflector 40V. Hence, when the engaging portion 61*a* of the stay 61 penetrates through the engaging hole 70*b* of the supporting side plate 70 while the reflector 40V is fastened to the stay 61 with the shoulder screw 43, the head 43*a* of the shoulder screw 43 is not caught by the engaging hole 70*b*. Accordingly, the engaging portion 61*a* penetrates through the engaging hole 70*b* smoothly, facilitating assembly of the stay 61 and the supporting side plate 70. If the reflector 40V is attached to the stay 61 after the engaging portion 61*a* penetrates through the engaging hole 70*b*, the reflector 40V need not penetrate through the engaging hole 70*b* that provides the clearance reduced by the engaging portion 61*a* of the stay 61 that has penetrated through the engaging hole 70*b*, thus facilitating assembly of the stay 61 and the supporting side plate 70.

Additionally, the length of the reflector 40V in the longitudinal direction thereof is smaller than the distance between the pair of supporting side plates 70, suppressing manufacturing costs of the material of the reflector 40V.

As illustrated in FIG. 22, one of the attachment positions where the reflector 40V is attached to the stay 61, which are disposed at both lateral ends of the reflector 40V in the longitudinal direction thereof, is disposed in an outboard span B1 disposed outboard from a center of the lateral end span B in the longitudinal direction of the reflector 40V. The attachment portion 40*b*1 depicted in FIG. 21B provided with the round hole 40*d* is situated in the outboard span B1. As described above, since the attachment portion 40*b*1 is situated in the outboard span B1 disposed outboard from the center of the lateral end span B in the longitudinal direction of the reflector 40V, the reflector 40V is attached to the stay 61 at a position in proximity to the supporting side plate 70. According to this variation of attachment of the reflector 40V to the stay 61, the attachment portion 40*b*1 having the round hole 40*d* and serving as a main reference for securing and positioning the reflector 40V to the stay 61 is attached to the stay 61 in the outboard span B1.

As described above, as the stay 61 is exerted with pressure from the pressure roller 30, the stay 61 is deformed and bent such that the stay 61 pivots about each lateral end of the stay 61 in the longitudinal direction thereof, which is supported by the supporting side plate 70. Since the reflector 40V is attached to the stay 61 at the position in proximity to the supporting side plate 70, the reflector 40V is secured to the stay 61 at a position in proximity to a position where the stay 61 is supported by the supporting side plate 70. Accordingly, even when the stay 61 is deformed and bent by pressure exerted from the pressure roller 30 such that the stay 61 pivots about each lateral end of the stay 61 in the longitudinal direction thereof, which is supported by the supporting side plate 70, the attachment position where the reflector 40V is attached to the stay 61 does not move in the short direction of the reflector 40V (e.g., the direction X). Consequently, when the stay 61 is bent, the reflector 40V is not displaced in the short direction of the reflector 40V (e.g., the direction X), suppressing decrease in reflection efficiency of the reflector 40V.

According to this variation of attachment of the reflector 40V to the stay 61, one of the attachment positions where the reflector 40V is attached to the stay 61, which are disposed at both lateral ends of the reflector 40V in the longitudinal direction thereof, is disposed in the outboard span B1 disposed outboard from the center of the lateral end span B in the longitudinal direction of the reflector 40V. Alternatively, both the attachment positions where the reflector 40V is attached to the stay 61 may be disposed in the outboard span B1 of the lateral end span B to suppress displacement of the reflector 40V in the short direction of the reflector 40V (e.g., the direction X) further when the stay 61 is bent.

Figure 23A:
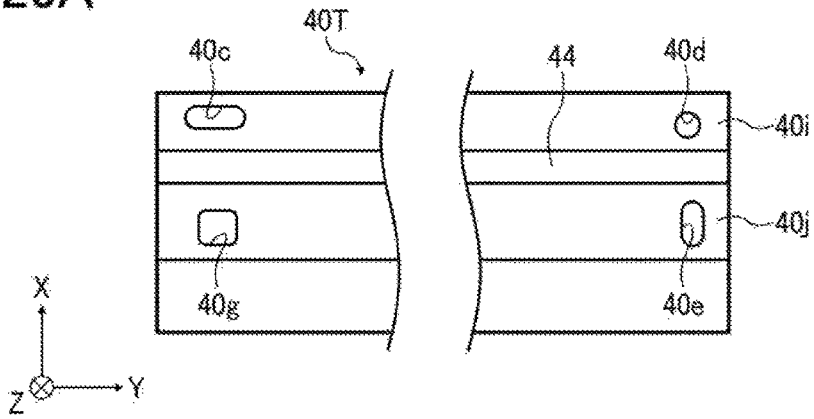
FIG. 23A is a schematic plan view of the reflector depicted in FIG. 17.
Figure 23B:
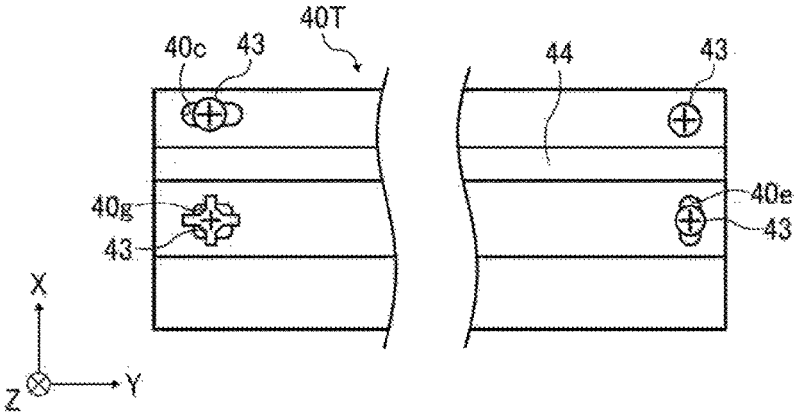
FIG. 23B is a schematic plan view of the reflector depicted in FIG. 17, which is attached to a stay.

FIGS 23A and 23B illustrate the reflector 40T attached to the stay 61 at two attachment positions aligned in a short direction of the reflector 40T. FIG. 23A is a schematic plan view of the reflector 40T. FIG. 23B is a schematic plan view of the reflector 40T attached to the stay 61. FIGS. 23A and 23B illustrate the reflector 40T depicted FIG. 17 that has the arch 44 disposed opposite and bulged toward each of the first halogen heater 50*a* and the second halogen heater 50*b*.

As illustrated in FIG. 23A, the round hole 40*d* of the reflector 40T is disposed on a distal plane 40*i* (e.g., an upper plane in FIG. 23A) disposed opposite a proximal plane 40*j* via the arch 44. The proximal plane 40*j* is disposed in proximity to the pressure pad 60 and in contact with a side face of the stay 61. The round hole 40*d* is disposed at one lateral end (e.g., a right end in FIG. 23A) of the distal plane 40*i* in a longitudinal direction of the reflector 40T. The elongate hole 40*c* of the reflector 40T is disposed at another lateral end (e.g., a left end in FIG. 23A) of the distal plane 40*i* in the longitudinal direction of the reflector 40T. The elongate hole 40*c* extends in the longitudinal direction of the reflector 40T. The reflector 40T includes an elongate hole 40*e* and a square hole 40*g*. The elongate hole 40*e* is disposed on the proximal plane 40*j* (e.g., a lower plane in FIG. 23A) disposed opposite the distal plane 40*i* via the arch 44. The proximal plane 40*j* is disposed in proximity to the pressure pad 60 and in contact with the side face of the stay 61. The elongate hole 40*e* is disposed at one lateral end (e.g., a right end in FIG. 23A,) of the proximal plane 40*j* in the longitudinal direction of the reflector 40T. The elongate hole 40*e* extends vertically in FIG. 23A in the short direction of the reflector 40T. The square hole 40*g* is disposed at another lateral end (e.g., a left end in FIG. 23A) of the proximal plane 40*j* in the longitudinal direction of the reflector 40T.

As illustrated in FIG. 23B, as the shank 43*c* of the shoulder screw 43 penetrates through each of the elongate hole 40*c*, the round hole 40*d*, the elongate hole 40*e*, and the square hole 40*g*, the shoulder screws 43 fasten the reflector 40T to the stay 61. A hole diameter of the round hole 40*d* is substantially equal to the diameter of the shank 43*c* of the shoulder screw 43. As the shoulder screw 43 is penetrated through the round hole 40*d* and screwed into the stay 61, the reflector 40T is positioned relative to the stay 61 in the direction X (e.g., the short direction of the reflector 40T) and the direction Y (e.g., the longitudinal direction of the reflector 40T).

Each of a short diameter in the direction X of the elongate hole 40*c* extending in the longitudinal direction of the reflector 40T and a short diameter in the direction Y of the elongate hole 40*e* extending in the short direction of the reflector 40T is substantially equal to the diameter of the shank 43*c* of the shoulder screw 43. As the shoulder screws 43 are penetrated through the elongate holes 40*c* and 40*e* and screwed into the stay 61, the reflector 40T is positioned relative to the stay 61 in the direction Z.

As a part of the head 43*a* of each of the shoulder screws 43 penetrating through the elongate hole 40*c*, the round hole 40*d*, the elongate hole 40*e*, and the square hole 40*g* is disposed opposite the reflector 40T, the reflector 40T is secured to and positioned relative to the stay 61 in the direction Z.

When the reflector 40T expands thermally in the longitudinal direction thereof, the elongate hole 40*c* extending in the longitudinal direction of the reflector 40T and the square hole 40*g* that are disposed at another lateral end (e.g., a left end in FIG. 23B) of the reflector 40T in the longitudinal direction thereof move leftward in FIG. 23B relative to the shoulder screws 43, allowing or releasing thermal expansion of the reflector 40T in the longitudinal direction thereof. Thus, the elongate hole 40*c* and the square hole 40*g* prevent the reflector 40T from being bent by thermal expansion in the longitudinal direction of the reflector 40T.

Conversely, when the reflector 40T expands thermally in the short direction thereof, the elongate hole 40*e* extending in the short direction of the reflector 40T disposed at one lateral end (e.g., a right end in FIG. 23B) of the reflector 40T in the longitudinal direction thereof and the square hole 40*g* move downward in FIG. 23B relative to the shoulder screws 43, allowing or releasing thermal expansion of the reflector 40T in the short direction thereof. Thus, the elongate hole 40*e* and the square hole 40*g* prevent the reflector 40T from being bent by thermal expansion in the short direction of the reflector 40T.

As illustrated in FIG. 1, the image forming apparatus 500 employs a vertical conveyance system to convey the transfer sheet S vertically upward. Accordingly, as illustrated in FIGS. 2, 3, 17, 18 and 19, the fixing belt 38 and the pressure roller 30 of the fixing devices 9, 9S, 9T, 9U, and 9V are aligned horizontally. Alternatively, the image forming apparatus 500 may employ a horizontal conveyance system to convey the transfer sheet S horizontally. In this case, the fixing devices 9, 9S, 9T, 9U, and 9V are rotated by 90 degrees so that the fixing belt 38 and the pressure roller 30 are aligned vertically. Yet alternatively, the image forming apparatus 500 may employ an oblique conveyance system to convey the transfer sheet S obliquely, in which the fixing belt 38 and the pressure roller 30 are aligned obliquely.

The embodiments described above are one example and attain advantages below in a plurality of aspects A to P.

A description is provided of advantages of a fixing device (e.g., the fixing devices 9, 9S, or 9T, 9U, and 9V) in the aspect A.

As illustrated in FIGS. 2, 3, 17, 18, and 19, the fixing device includes a rotator (e.g., the fixing belt 38), an abutment (e.g., the pressure roller 30), a nip formation pad (e.g., the pressure pad 60), a support (e.g., the stay 61), a heat generator (e.g., the first halogen heater 50*a* and the second halogen heater 50*b*), a holder (e.g., the supporting side plate 70), a reflector (e.g., the reflectors 40, 40S, 40T, 40U, and 40V), and a fastener (e.g., the shoulder screw 43).

The rotator is an endless belt rotatable in a rotation direction (e.g., the rotation direction D38). The rotator is formed into a loop. The abutment contacts or presses against an outer circumferential surface of the rotator. The nip formation pad is disposed inside the loop formed by the rotator and disposed opposite an inner circumferential surface of the rotator to press against the abutment via the rotator to form a fixing nip (e.g., the fixing nip SN) between the rotator and the abutment. The support supports the nip formation pad. The heat generator is disposed inside the loop formed by the rotator and disposed opposite the inner circumferential surface of the rotator to heat the rotator.

As illustrated in FIG. 9, the heat generator includes a heat generating portion (e.g., the second light emitting filament 51*b*). The holder holds each lateral end of the support in a longitudinal direction of the support that is perpendicular to the rotation direction of the rotator. As illustrated in FIGS. 2, 3, 17, 18 and 19, the reflector, disposed inside the loop formed by the rotator and disposed opposite the inner circumferential surface of the rotator, includes a reflection face (e.g., the reflection face 40*f*, 40*f*S, 40*f*T, 40*f*U, and 40*f*V) to reflect radiant heat or light radiated from the heat generator toward the rotator. As illustrated in FIG. 15, the fastener fastens the reflector to the support at an attachment position disposed at each lateral end of the reflector in a longitudinal direction thereof. The attachment position where the reflector is attached to the support is disposed outboard from a lateral edge of the heat generating portion of the heat generator and disposed inboard from the holder in the longitudinal direction of the reflector.

A description is provided of a construction of a second comparative fixing device.

The second comparative fixing device includes a fixing belt serving as a rotator. A tubular metallic member is disposed opposite an inner circumferential surface of the fixing belt in an outboard span other than a fixing nip in a rotation direction of the fixing belt. As the metallic member is heated by a heat generator with radiant heat, the metallic member heats the fixing belt. The metallic member, the heat generator, and a stay are penetrated through side plates serving as a holder and held by the side plates. A screw serving as a fastener attaches a reflector to the stay at an attachment position outboard from a lateral edge of the metallic member penetrating through the side plate, that is, a position outboard from the side plate, in a longitudinal direction of the reflector.

If the attachment position where the reflector is attached to the stay is disposed outboard from the holder in the longitudinal direction of the reflector like in the second comparative fixing device, when each lateral end of the stay in a longitudinal direction thereof penetrates through the holder while the fastener fastens the reflector to the stay, the fastener may be caught in a hole of the holder through which the stay penetrates. Accordingly, the stay may not penetrate through the holder smoothly, degrading assembly of the stay and the holder. Additionally, if the reflector is attached to the stay after the stay penetrates through the holder, the reflector need to penetrate through the hole of the holder that provides a clearance reduced by the stay penetrating through the holder. Accordingly, the reflector may not penetrate readily through the hole of the holder through which the stay has penetrated, degrading assembly of the stay and the holder.

To address those circumstances, in the aspect A, the attachment position where the reflector is attached to the support (e.g., the stay) is disposed inboard from the holder in the longitudinal direction of the reflector. Since the attachment position where the reflector is attached to the support is disposed closer to a center of the support in the longitudinal direction thereof than the holder is, when each lateral end of the support in the longitudinal direction thereof penetrates through the holder while the fastener fastens the reflector to the support, the fastener may not be caught in a hole of the holder through which the support penetrates. Accordingly, the support penetrates through the holder smoothly, facilitating assembly of the support and the holder.

Additionally, if the reflector is attached to the support after the support penetrates through the holder, the reflector need not penetrate through the hole of the holder that provides a clearance reduced by the support penetrating through the holder, thus facilitating assembly of the reflector and the holder.

Even if the attachment position where the reflector is attached to the support is disposed inboard from the holder in the longitudinal direction of the reflector, if the attachment position is disposed inboard from the lateral edge of the heat generating portion of the heat generator in the longitudinal direction of the reflector, a part of radiant heat radiated from the heat generator may irradiate the fastener. A reflectance of the fastener to reflect radiant heat is lower than a reflectance of the reflection face of the reflector. Hence, heating efficiency of heating the rotator may degrade.

To address this circumstance, in the aspect A, the attachment position where the reflector is attached to the support is disposed outboard from the lateral edge of the heat generating portion of the heat generator and disposed inboard from the holder in the longitudinal direction of the reflector. Thus, the support is attached to the holder smoothly. Additionally, compared to a configuration in which the attachment position where the reflector is attached to the support is disposed inboard from the lateral edge of the heat generating portion of the heat generator in the longitudinal direction of the reflector, the reflector reduces radiant heat that irradiates the fastener. Accordingly, compared to the configuration in which the attachment position where the reflector is attached to the support is disposed inboard from the lateral edge of the heat generating portion of the heat generator in the longitudinal direction of the reflector, the reflector suppresses decrease in heating efficiency of heating the rotator.

Thus, the reflector and the support are assembled readily.

A description is provided of advantages of the fixing device in the aspect B.

In the aspect A, as illustrated in FIG. 22, the attachment position where the reflector is attached to the support is disposed outboard from a center of a lateral end span (e.g., the lateral end span B) between the lateral edge of the heat generating portion of the heat generator and the holder in the longitudinal direction of the reflector. Accordingly, as described above in the embodiments, the attachment position where the reflector is attached to the support is disposed in proximity to the holder that holds the support. The support is deformed by pressure exerted by the abutment such that the support pivots about a position where the support is held by the holder. To address this circumstance, the attachment position where the reflector is attached to the support is disposed in proximity to the position where the holder holds the support, thus suppressing displacement of the attachment position when the support deforms. Accordingly, the reflector does not move in accordance with displacement of the attachment position, thus retaining an improved heating efficiency of heating the rotator with the shape of the reflection face of the reflector.

A description is provided of advantages of the fixing device in the aspect C.

In the aspect A or B, as illustrated in FIGS. 3, 17, 18, and 19, the reflector includes the reflection face disposed opposite the heat generator at an angle that varies. Accordingly, as described above in the embodiments, the reflection face of the reflector prevents radiant heat or light radiated from the heat generator and reflected by the reflection face of the reflector from being directed to the heat generator.

A description is provided of advantages of the fixing device in the aspect D.

As illustrated in FIGS. 2, 3, 17, 18, and 19, the fixing device (e.g., the fixing devices 9, 9S, 9T, 9U, and 9V) includes the rotator (e.g., the fixing belt 38), that is, an endless fixing belt being formed into a loop and rotatable in the rotation direction (e.g., the rotation direction D38). The abutment (e.g., the pressure roller 30) presses against or contacts the outer circumferential surface of the rotator. The nip formation pad (e.g., the pressure pad 60) is disposed inside the loop formed by the rotator and disposed opposite the inner circumferential surface of the rotator to press against the abutment via the rotator to form the fixing nip (e.g., the fixing nip SN) between the rotator and the abutment. The support (e.g., the stay 61) supports the nip formation pad. The heat generator (e.g., the first halogen heater 50*a* and the second halogen heater 50*b*) is disposed inside the loop formed by the rotator and disposed opposite the inner circumferential surface of the rotator to heat the rotator. The reflector (e.g., the reflectors 40, 40S, 40T, 40U, and 40V) is supported by the support and includes the reflection face (e.g., the reflection faces 40*f*, 40*f*S, 40*f*T, 40*f*U, and 40*f*V) to reflect radiant heat or light radiated from the heat generator toward the rotator.

As illustrated in FIG. 15, the fastener (e.g., the shoulder screw 43) fastens the reflector to the support directly or indirectly at the attachment position disposed at each lateral end of the reflector in the longitudinal direction thereof.

As illustrated in FIGS. 3, 17, and 18, the reflection face of the reflector includes an angled portion, that is, at least one of a bent portion (e.g., the bent portion 40*a*), an arch (e.g., the arch 44), a recess (e.g., the recess 45), and a gable (e.g., the gable 46), which is disposed on at least a part of the reflection face and angled relative to a pressurization direction (e.g., the pressurization direction DR depicted in FIG. 19) in which the abutment is pressed against the nip formation pad via the rotator.

As illustrated in FIGS. 20A and 20B, the reflector includes an attachment portion (e.g., the attachment portions 40*b*1 and 40*b*2) contacting the fastener. The attachment portion prevents the reflector from being deformed in accordance with deformation of the support by pressure exerted by the abutment as the support pivots about the fastener in a surface direction parallel to the reflection face of the reflector.

A third comparative fixing device includes a rotator that is tubular and rotatable; an abutment contacting an outer circumferential surface of the rotator; and a nip formation pad that is disposed inside the rotator and presses against the abutment via the rotator to form a fixing nip between the rotator and the abutment. A stay supports the nip formation pad. A reflector is attached to the stay. The reflector includes a reflection face that reflects radiant heat or light radiated from a heat generator toward the rotator.

The second comparative fixing device includes a stationary member (e.g., a nip formation pad) and a reinforcement (e.g., the stay) that reinforces the mechanical strength of the stationary member. Each lateral end of the reinforcement in a longitudinal direction thereof that is perpendicular to a sheet conveyance direction is secured to and supported by the side plate of the second comparative fixing device. The reinforcement divides an interior of the fixing belt serving as a rotator into two compartments. One lateral end face of the reinforcement in the longitudinal direction thereof contacts the stationary member and presses against a pressure roller serving as an abutment via the stationary member and the fixing belt. The reflector is mounted on an opposed face of the reinforcement, which is disposed opposite a heater serving as the heat generator.

The reflector includes a reflection face having a center portion disposed opposite the heater and bulged toward the heater in a cross-section perpendicular to the longitudinal direction of the reflector so as to enhance heating efficiency of heating the fixing belt. The bulged center portion of the reflection face diffuses and reflects radiant heat or light radiated from the heater and directed to the inner circumferential surface of the fixing belt. Accordingly, compared to a configuration in which the reflection face of the reflector is planar, the bulged center portion of the reflection face causes radiant heat or light radiated from the heater to irradiate the fixing belt evenly in an increased span of the fixing belt, thus enhancing heating efficiency of heating the fixing belt.

The reflector is fastened to the reinforcement with a screw at one lateral end of the reflector and a shoulder screw at another lateral end of the reflector in the longitudinal direction thereof. The reflector includes an attachment portion where the shoulder screw fastens the reflector to the reinforcement. The attachment portion of the reflector is provided with an elongate hole extending in the longitudinal direction of the reflector. When the reflector is heated by the heater and expands thermally, a step of the shoulder screw slides relatively inside the elongate hole, preventing the reflector from being warped in the longitudinal direction thereof.

However, the second comparative fixing device may suffer from degradation in heating efficiency of heating the fixing belt with the shape of the reflection face of the reflector.

The reflector is fastened to the reinforcement with the screw at one lateral end of the reflector in the longitudinal direction thereof. Accordingly, when pressure exerted from the pressure roller bends the reinforcement, which presses against the pressure roller via the stationary member and the fixing belt, toward the interior of the fixing belt, static friction may generate between a vicinity of the screw screwed in the reflector and the reinforcement. The static friction causes the reflector to deform in accordance with deformation of the reinforcement. For example, the reflector deforms such that the support pivots about a portion of the reflector that is fastened to the reinforcement with the screw toward the interior of the fixing belt. As the reflector deforms, the bulged reflection face of the reflector may shift from the heat generator, resulting in degradation in heating efficiency of heating the fixing belt with the shape of the bulged reflection face of the reflector.

Alternatively, in view of enhancement of heating efficiency of heating the fixing belt, other than the bulged reflection face, at least a part of the reflection face that is angled relative to a pressurization direction in which the pressure roller is pressed against the fixing belt may also suffer from degradation in heating efficiency of heating the fixing belt.

In the aspect D, as described above in the embodiments, even if the support is deformed by pressure exerted by the abutment, the reflector is immune from transmission of deformation of the support in a surface direction of the reflection face, which may cause the support to pivot about the fastener, thus attaining advantages below. For example, the reflector does not deform in accordance with deformation of the support such that the support pivots about the fastener in the surface direction of the reflection face of the reflector. Accordingly, even if the support is bent inward toward the interior of the rotator by pressure from the abutment, the reflector does not deform in accordance with bending of the support. Consequently, even if the support is bent, a slope of the reflector does not deviate from the heat generator, retaining a precise positional relation between the heat generator and the reflector. Hence, even if the support is bent, the slope of the reflector retains the precise positional relation with the heat generator, thus retaining an improved heating efficiency of the reflection face of the reflector to heat the rotator.

A description is provided of advantages of the fixing device in the aspect E.

In the aspect D, the fastener (e.g., the shoulder screw 43) restricts motion of the support (e.g., the stay 61) and the like at least in a deformation direction of the support deformed by pressure exerted by the abutment (e.g., the pressure roller 30).

A description is provided of advantages of the fixing device in the aspect F.

In any one of the aspects C to E, the reflection face of the reflector includes a slope (e.g., the bent portion 44*a*, the arch 44, the recess 45, and the gable 46) disposed opposite the heat generator to reflect the radiant heat or light radiated from the heat generator in a direction not directed to the heat generator.

In the aspect F, as described above in the embodiments, the reflection face of the reflector reflects radiant heat or light irradiating the reflection face toward an inner circumferential surface of the rotator, not toward the heat generator, preventing the radiant heat or light from penetrating through the heat generator and preventing the reflected heat or light from heating the heat generator.

A description is provided of advantages of the fixing device in the aspect G.

In any one of the aspects A to F, as illustrated in FIGS. 20A, 20B, 21A, 21B, 21C, 22, 23A, and 23B, the reflector includes through holes (e.g., the elongate hole 40*c*, the round hole 40*d*, and the elongate hole 40*e*) disposed at both lateral ends of the reflector in the longitudinal direction thereof, respectively. The fasteners penetrate through the through holes, respectively. One of the through holes is an elongate hole (e.g., the elongate hole 40*c*) extending in the longitudinal direction of the reflector.

Accordingly, as described in the embodiments, when the reflector expands thermally, the elongate hole moves relative to the fastener, allowing or releasing thermal expansion of the reflector. Consequently, the elongate hole suppresses bending and deformation of the reflector due to thermal expansion of the reflector.

A description is provided of advantages of the fixing device in the aspect H.

In any one of the aspects A to G, the reflector is attached to the support at a single position in the pressurization direction (e.g., the pressurization direction DR) in which the abutment is pressed against the rotator.

Accordingly, as described above in the embodiments, the reflector expands thermally in the pressurization direction, thus being immune from deformation due to thermal expansion.

A description is provided of advantages of the fixing device in the aspect I.

In any one of the aspects A to H, as illustrated in FIG. 21A, the fastener includes a first portion (e.g., the thread 43*b*), a second portion (e.g., the shank 43*c*), and a third portion (e.g., the head 43*a*). The first portion is secured to the support. A second diameter of the second portion is greater than a first diameter of the first portion. The second portion penetrates through the reflector in a fastening direction in which the fastener fastens the reflector to the support. The second portion contacts a contact face (e.g., a contact face 61*c* depicted in FIG. 8) of the support, which is perpendicular to the fastening direction. A third diameter of the third portion is greater than the second diameter of the second portion. A part of the third portion is disposed opposite the reflection face of the reflector. A thickness of the second portion in the fastening direction is set to provide a predetermined gap (e.g., the gap A) between the third portion and the reflector.

Accordingly, the fastener prevents deformation of the support that pivots about the fastener in the surface direction of the reflection face of the reflector when the support receives pressure from the abutment from adversely affecting the reflector. For example, the reflector is immune from deformation in accordance with deformation of the support in the surface direction of the reflection face of the reflector, which may occur as the support pivots about the fastener. Hence, even if the support is bent toward the interior of the rotator by pressure from the abutment, the reflector is not deformed in accordance with bending of the support. Consequently, even if the support is bent, the slope of the reflector does not deviate from the heat generator, retaining a precise positional relation between the heat generator and the reflector. Hence, even if the support is bent, the slope of the reflector retains the precise positional relation with the heat generator, thus retaining an improved heating efficiency of the reflection face of the reflector to heat the rotator.

A description is provided of advantages of the fixing device in the aspect J.

In any one of the aspects A to I, as illustrated in FIG. 19, the support includes a base or a contact portion (e.g., the base 61*g*) and an arm (e.g., the arm 61*h*). The base contacts the nip formation pad. The arm projects from the base toward the interior of the rotator. The heat generator is disposed opposite a side face (e.g., a side face 61*h*1) of the arm. The side face of the arm supports the reflector.

A description is provided of advantages of the fixing device in the aspect K.

In the aspect J, the fastener attaches the reflector to the side face of the arm of the support and allows at least one of a parallel motion, a separating motion, and a tilting motion of the reflector. In the parallel motion, the reflector moves in the longitudinal direction thereof and in parallel to the side face of the arm. In the separating motion, the reflector separates from the side face of the arm perpendicularly to the side face of the arm for a predetermined distance. In the tilting motion, the reflector is tilted relative to the side face of the arm at a predetermined angle.

A description is provided of advantages of the fixing device in the aspect L.

In the aspect J or K, as illustrated in FIG. 19, the reflector includes two parallel planes (e.g., the first reflection plane 46A and the third reflection plane 46D) and a tilt plane (e.g., the second reflection plane 46B). The two parallel planes are unevenly parallel to the arm of the support. The tilt plane is tilted relative to the parallel planes and bridges the parallel planes.

Accordingly, as illustrated in FIG. 19, the reflector prevents radiation heat or light radiated from the heat generator and reflected by the reflection face of the reflector from being directed to the heat generator.

A description is provided of advantages of the fixing device in the aspect M.

In the aspect J or K, the reflection face of the reflector includes a protection or a bulge (e.g., the arch 44 and the gable 46) that projects from the reflection face of the reflector toward the heat generator. The support mounts the reflector such that the reflector is interposed between the heat generator and the arm of the support and a center of the heat generator in a direction perpendicular to an axial direction of the rotator is on a hypothetical extension from the projection in a projection direction thereof.

Accordingly, as described above in the embodiments, the reflection face of the reflector reflects radiant heat or light irradiating the reflection face toward the rotator, not toward the heat generator, preventing the radiant heat or light from penetrating through the heat generator and preventing the reflected heat or light from heating the heat generator.

A description is provided of advantages of the fixing device in the aspect N.

In the aspect M, as illustrated in FIG. 3, the projection is a gable (e.g., the gable 46) that projects from the reflection face of the reflector toward the heat generator.

Accordingly, as described above in the embodiments, as radiant heat or light irradiates a slope (e.g., the slope 46*a*) of the gable disposed opposite the heat generator in an incident direction, the slope reflects the radiant heat or light in a direction different from the incident direction. Thus, the gable on the reflection face reflects the radiant heat or light toward the rotator, not toward the heat generator, preventing the radiant heat or light from penetrating through the heat generator.

A description is provided of advantages of the fixing device in the aspect O.

In the aspect M, as illustrated in FIG. 17, the projection is an arch (e.g., the arch 44) that bulges from the reflection face of the reflector toward the heat generator.

Accordingly, as described above in the embodiments, as radiant heat or light irradiates a surface of the arch disposed opposite the heat generator in the incident direction, the arch reflects the radiant heat or light in a direction different from the incident direction. Thus, the arch on the reflection face reflects the radiant heat or light toward the rotator, not toward the heat generator, preventing the radiant heat or light from penetrating through the heat generator.

A description is provided of advantages of the fixing device in the aspect P.

As illustrated in FIG. 1, an image forming apparatus (e.g., the image forming apparatus 500) includes an image forming device (e.g., the image forming devices 1Y, 1M, 1C, and 1K of the image forming section 200) to form a toner image on a recording medium (e.g., a transfer sheet S) with toner and a fixing device (e.g., the fixing devices 9, 9S, 9T, 9U, and 9V) disposed downstream from the image forming device in a recording medium conveyance direction (e.g., the sheet conveyance direction DS) to fix the toner image on the recording medium under heat and pressure. The fixing device attains any one of the aspects A to O.

Accordingly, as described above in the embodiments, the fixing device retains heating efficiency of heating the rotator and therefore allows the entire image forming apparatus to save energy.

According to the embodiments described above, the fixing belt 38 serves as a rotator. Alternatively, a fixing film, a fixing sleeve, or the like may be used as a rotator. Further, the pressure roller 30 serves as an abutment. Alternatively, a pressure belt or the like may be used as an abutment.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a rotator being formed into a loop and rotatable in a rotation direction;

an abutment to press against an outer circumferential surface of the rotator;

a heat generator disposed inside the loop formed by the rotator, the heat generator including a heat generating portion to radiate radiant heat;

a reflector disposed inside the loop formed by the rotator, the reflector including a reflection face to reflect the radiant heat radiated from the heat generator toward the rotator;

a support supporting the reflector;

a holder holding each lateral end of the support in a longitudinal direction of the support, which is perpendicular to the rotation direction of the rotator; and a fastener attaching the reflector to the support at an attachment position disposed at each lateral end of the reflector in a longitudinal direction of the reflector, the attachment position being disposed outboard from a lateral edge of the heat generating portion of the heat generator and disposed inboard from the holder in the longitudinal direction of the reflector.

2. The fixing device according to claim 1, wherein the attachment position is disposed outboard from a center of a lateral end span between the lateral edge of the heat generating portion of the heat generator and the holder in the longitudinal direction of the reflector.

3. The fixing device according to claim 1, wherein the reflection face of the reflector is disposed opposite the heat generator at an angle that varies.

4. A fixing device comprising:

a rotator being formed into a loop and rotatable in a rotation direction;

an abutment to press against an outer circumferential surface of the rotator in a pressurization direction;

a heat generator, disposed inside the loop formed by the rotator, to radiate radiant heat;

a reflector disposed inside the loop formed by the rotator;

a support supporting the reflector; and a fastener fastening the reflector to the support at an attachment position disposed at each lateral end of the reflector in a longitudinal direction of the reflector, the reflector including:

a reflection face to reflect the radiant heat radiated from the heat generator toward the rotator, the reflection face including an angled portion angled relative to the pressurization direction and disposed on at least a part of the reflection face; and an attachment portion, contacting the fastener, to prevent the reflector from being deformed in accordance with deformation of the support by pressure exerted by the abutment and being pivoted about the fastener in a surface direction parallel to the reflection face of the reflector.

5. The fixing device according to claim 4, wherein the fastener restricts motion of the support as least in a deformation direction of the support deformed by the pressure exerted by the abutment.

6. The fixing device according to claim 4, wherein the reflection face of the reflector further includes a slope, disposed opposite the heat generator, to reflect the radiant heat radiated from the heat generator in a direction not directed to the heat generator.

7. The fixing device according to claim 4, wherein the reflector further includes a plurality of through holes disposed at both lateral ends of the reflector in the longitudinal direction of the reflector, respectively, and wherein the fastener penetrates through each of the through holes.

8. The fixing device according to claim 7, wherein one of the through holes includes an elongate hole being disposed at one lateral end of the reflector in the longitudinal direction of the reflector and extending in one of the longitudinal direction of the reflector and a direction perpendicular to the longitudinal direction of the reflector.

9. The fixing device according to claim 8, wherein another one of the through holes includes one of a round hole and a square hole disposed at another lateral end of the reflector in the longitudinal direction of the reflector.

10. The fixing device according to claim 4, wherein the reflector is attached to the support at a single position in the pressurization direction.

11. The fixing device according to claim 4, wherein the fastener includes:

a first portion having a first diameter and being secured to the support;

a second portion having a second diameter greater than the first diameter of the first portion, the second portion penetrating through the reflector in a fastening direction in which the fastener fastens the reflector to the support, the second portion contacting a contact face of the support, which is perpendicular to the fastening direction; and a third portion having a third diameter greater than the second diameter of the second portion, the third portion including a part disposed opposite the reflection face of the reflector, and wherein a thickness of the second portion in the fastening direction is set to provide a predetermined gap between the third portion and the reflector.

12. The fixing device according to claim 4, wherein the fastener includes a shoulder screw.

13. The fixing device according to claim 4, wherein the support includes:

a base; and an arm projecting from the base toward an interior of the rotator and including a side face being disposed opposite the heat generator and supporting the reflector.

14. The fixing device according to claim 13, wherein the fastener attaches the reflector to the side face of the arm of the support and allows at least one of a parallel motion in which the reflector moves in the longitudinal direction of the reflector and in parallel to the side face of the arm, a separating motion in which the reflector separates from the side face of the arm perpendicularly to the side face of the arm for a predetermined distance, and a tilting motion in which the reflector is tilted relative to the side face of the arm at a predetermined angle.

15. The fixing device according to claim 13, wherein the reflector further includes:

two parallel planes being unevenly parallel to the arm of the support; and a tilt plane being tilted relative to the two parallel planes and bridging the two parallel planes.

16. The fixing device according to claim 13, wherein the reflection face of the reflector further includes a projection projecting toward the heat generator, and wherein the reflector attached to the support is interposed between the heat generator and the arm of the support and a center of the heat generator in a direction perpendicular to an axial direction of the rotator is on a hypothetical extension from the projection in a projection direction of the projection.

17. The fixing device according to claim 16, wherein the projection includes a gable projecting toward the heat generator.

18. The fixing device according to claim 16, wherein the projection includes an arch bulging toward the heat generator.

19. The fixing device according to claim 4, further comprising a nip formation pad to press against the abutment via the rotator to form a fixing nip between the rotator and the abutment.

20. An image forming apparatus comprising:

an image forming device to form a toner image on a recording medium; and a fixing device to fix the toner image on the recording medium, the fixing device including:

a rotator being formed into a loop and rotatable in a rotation direction;

an abutment to press against an outer circumferential surface of the rotator;

a heat generator disposed inside the loop formed by the rotator, the heat generator including a heat generating portion to radiate radiant heat;

a reflector disposed inside the loop formed by the rotator, the reflector including a reflection face to reflect the radiant heat radiated from the heat generator toward the rotator;

a support supporting the reflector;

a holder holding each lateral end of the support in a longitudinal direction of the support, which is perpendicular to the rotation direction of the rotator; and a fastener attaching the reflector to the support at an attachment position disposed at each lateral end of the reflector in a longitudinal direction of the reflector, the attachment position being disposed outboard from a lateral edge of the heat generating portion of the heat generator and disposed inboard from the holder in the longitudinal direction of the reflector.

* * * * *